US005264333A

United States Patent [19]

Yamanouchi et al.

[11] Patent Number: 5,264,333

[45] Date of Patent: Nov. 23, 1993

[54] SILVER HALIDE PHOTOGRAPHIC MATERIAL

[75] Inventors: Junichi Yamanouchi; Satoru Toda; Koji Tamoto, all of Kanagawa, Japan

[73] Assignee: Fuji Photo Film Co., Ltd., Kanagawa, Japan

[21] Appl. No.: 22,100

[22] Filed: Feb. 25, 1993

[30] Foreign Application Priority Data

Feb. 26, 1992 [JP] Japan ..... 4-073053

[51] Int. Cl.[5] ..... G03C 1/06

[52] U.S. Cl. ..... 430/517; 430/510; 430/522; 430/531

[58] Field of Search ..... 430/510, 517, 522, 531

[56] References Cited

U.S. PATENT DOCUMENTS

| | | | |
|---|---|---|---|
| 4,716,099 | 12/1987 | Simens | 430/510 |
| 4,940,654 | 7/1990 | Diehl et al. | 430/522 |
| 4,948,718 | 8/1990 | Factor et al. | 430/522 |
| 4,950,586 | 8/1990 | Diehl et al. | 430/517 |
| 4,990,435 | 3/1991 | Vallari et al. | 430/517 |
| 5,155,015 | 10/1992 | Jimbo | 430/517 |

FOREIGN PATENT DOCUMENTS

| | | |
|---|---|---|
| 0353714 | 2/1990 | European Pat. Off. . |
| 0383354 | 8/1990 | European Pat. Off. . |
| 0423693 | 4/1991 | European Pat. Off. . |
| 0434026 | 6/1991 | European Pat. Off. . |

*Primary Examiner*—Jack P. Brammer

*Attorney, Agent, or Firm*—Sughrue, Mion, Zinn, Macpeak & Seas

[57] ABSTRACT

A silver halide photographic material has at least one hydrophilic colloid layer containing a dispersion obtained by emulsifying and dispersing a solution containing at least one oil-soluble dye and at least one water-insoluble, organic solvent-soluble polymer having at least one repeating unit represented by the following general formula (I):

(I)

wherein $R^1$ represents a hydrogen atom, a substituted or unsubstituted alkyl group having 1 to 4 carbon atoms, or a halogen atom; $R^2$ and $R^3$ may be the same or different and each represents a substituted or unsubstituted alkyl group or a substituted or unsubstituted aryl group; L represents a bivalent bonding group; and $n_1$ represents 0 or 1.

9 Claims, No Drawings

SILVER HALIDE PHOTOGRAPHIC MATERIAL

FIELD OF THE INVENTION

This invention relates to a silver halide photographic material having a dyed layer, and more particularly to a silver halide photographic material having a hydrophilic colloid layer containing a dye which is photochemically inert and can be easily decolorized and/or dissolved out by photographic processing.

BACKGROUND OF THE INVENTION

The photographic emulsion layers and other hydrophilic colloid layers of silver halide photographic materials are often colored to allow light in a specific wavelength region to be absorbed.

When the spectral composition of light which enters a photographic emulsion layer must be controlled, a colored layer is usually provided on the side of the photographic emulsion layer which is farther away from the support. Such a colored layer is called a filter layer. When there are two or more photographic emulsion layers, a filter layer is often provided therebetween.

A colored layer called an antihalation layer is often coated between the emulsion and the support or on the back of the support to prevent the image from being fogged, that is, to prevent halation. Halation is an effect in which light which is diffusely transmitted by the emulsion and strikes the back surface of a transparent support is partially or totally reflected back to the emulsion and reexposes it at a considerable distance from the initial point of entry See T. H. James, The Theory of the photographic Process 579,599 (4th ed. 1977). When there are two or more photographic emulsion layers, an antihalation layer is often provided therebetween.

The photographic emulsion layer is sometimes colored to prevent the sharpness of an image from being lowered by the scattering of light in the photographic emulsion layer (this phenomenon is generally called irradiation).

These hydrophilic colloid layers to be colored usually contain dyes. The dyes must meet the following conditions:

(1) The dyes must have proper spectral absorption according to purpose.

(2) The dyes must be photochemically inert, that is, they must not have any adverse effect on the performance of the silver halide emulsion layers in a chemical sense. For example, the dyes must not cause lowering of sensitivity, fading of the latent image, fogging, etc.

(3) The dyes must be decolorized during the course of photographic processing or must be dissolved out into processing solutions or rinsing water so that no deleterious color is left behind in the photographic material after processing.

(4) The dyes must not diffuse from the dyed layer into other layers.

(5) The dyes must have excellent stability in solution or photographic materials with the passage of time and not discolor.

Particularly, when the colored layer is a filter layer or an antihalation layer provided on the same side of the support as the photographic emulsion layer, it is necessary that the colored layer be selectively colored and that other layers not be substantially affected by the coloration. Otherwise, the coloration may have a deleterious spectral effect on other layers, and the effect of the colored layer as a filter layer or an antihalation layer will be diminished. However, when a dye-containing layer and another hydrophilic layer are brought into contact with each other in a wetted state, there is frequently a problem in that a part of the dye diffuses from the former into the latter. Many attempts have been made in the art to prevent the diffusion of the dye from occurring.

For example, U.S. Pat. Nos. 2,548,564, 4,124,386 and 3,625,694 disclose a method wherein a hydrophilic polymer, as a mordant, having a charge opposite to a dissociated anionic dye is allowed to coexist with the dye, and the dye is localized to a specific layer by an interaction between the polymer and the dye molecule.

However, the dye fixing/decolorization method using the mordant requires the use of a large amount of the mordant in comparison with the amount of the anionic dye, and hence the thickness of the colored layer inevitably becomes thick. For example, when the colored layer is used as the filter layer of a photographic material for photographing, the increase of the thickness of the layer causes a problem in that the sharpness of the resulting image is deteriorated. Further, in the system using the mordant, the mordant must not interfere with the sensitizing dye used for silver halide emulsions. However, the decoloration performance is not on a satisfactory level with the development of high-quality images and rapid processing of photographic materials in recent years.

A method wherein a specific layer is dyed with water-insoluble solid dyes is disclosed in JP-A-56-12639 (the term "JP-A" as used herein means an "unexamined published Japanese patent application"), JP-A-55-155350, JP-A-55-155351, JP-A-63-27838, and JP-A-63-197943, European Patents 15,601, 274,723, 276,566 and 299,435, U.S. Pat. No. 4,803,150 and WO (PCT) 88/04794.

Further, a method wherein a specific layer is dyed with fine metal salt particles having a dye adsorbed thereon is disclosed in U.S. Pat. Nos. 2,719,088, 2,496,841 and 2,496,843 and JP-A-60-45237.

These dyeing methods are excellent in terms of fixability/decolorizability, but problems often occur, for example, when the dyes are to be used as filter dyes for light having a specific wavelength.

A method wherein oil-soluble dyes together with high-boiling organic solvents are dispersed is disclosed in JP-A-61-204630, JP-A-61-205934, JP-A-62-32460, JP-A-62-56958, JP-A-62-92949, JP-A-62-222248, JP-A-63-40143, JP-A-63-184749 and JP-A-63-316852.

However, the use of the high boiling organic solvents causes softening of the colored layer and lowering in the strength of the layer. Accordingly, a larger amount of gelatin is required and as a result, the thickness of the layer is increased contrary to demands for thinning the thickness of the layer.

JP-B-51-39853 (the term "JP-B" as used herein means an "examined Japanese patent publication") JP-A-51-59943, JP-A-53-137131, JP-A-54-32552, JP-A-54-107941, JP-A-56-126830, JP-A-58-149038, and U.S. Pat. Nos. 4,199,363, 4,203,716 and 4,990,435 disclose a method wherein a polymer is impregnated with a solution of a hydrophobic material such as a dye in an organic solvent to form a polymer latex loaded with the hydrophobic material. This method avoids the problem caused by the use of the high-boiling organic solvents since the polymer is used. However, there are disadvantages in that the stability of polymer latex particles is insufficient during impregnation, and the particles are liable to agglomerate; a large amount of the polymer must be used to sufficiently impregnate the hydrophobic material therewith; much time and labor are required for the removal of a water-soluble co-solvent used for the impregnation; and the process itself requires a long time and is complicated.

The present inventors have made studies and have found that when a dispersion obtained by emulsifying and dispersing a solution containing a water-insoluble, organic solvent-soluble polymer and an oil-soluble dye is used, a specific layer can be selectively dyed and the dye can be decolorized in processing stages without having any adverse effect on the absorption characteristics of the dye and the strength of the layer. However, the compatibility of the organic solvent-soluble polymer with the oil-soluble dye is not always sufficient and problems are encountered, such as that solubility of the dyes in organic solvents is low or that when high-melting dyes are used, the absorption zone is broadened and the absorption intensity at the maximum absorption wavelength is lowered.

These problems can be solved to some degree by increasing the proportion of the polymer to be dispersed or by using the high-boiling organic solvent together with the dye dispersion. However, any of these methods results in an increase of the thickness of the dyed layer contrary to demands of thinning the thickness of the layer to provide an image of high quality. Hence, the degree of the improvement is still not on a satisfactory level.

SUMMARY OF THE INVENTION

Accordingly, objects of the present invention are to provide a silver halide photographic material having at least one hydrophilic colloid layer containing a novel dye dispersion which is excellent in manufacturability, can selectively dye a specific layer and is excellent in decolorizability or an ability of dissolving-out in processing stages without having any adverse effect on the absorption characteristics of dyes and the strength of the layer.

The above-described objects of the present invention have been achieved by providing:

(1) a silver halide photographic material having at least one hydrophilic colloid layer containing a dispersion obtained by emulsifying and dispersing a solution containing at least one oil-soluble dye and at least one water-insoluble organic solvent-soluble polymer having at least one repeating unit represented by the following general formula (I):

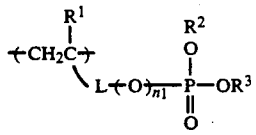

(I)

wherein $R^1$ represents a hydrogen atom, a substituted or unsubstituted alkyl group having 1 to 4 carbon atoms, or a halogen atom; $R^2$ and $R^3$ may be the same or different and each represents a substituted or unsubstituted alkyl group or a substituted or unsubstituted aryl group; L represents a bivalent bonding group; and $n_1$ represents 0 or 1.

(2) A preferred embodiment of the invention is a silver halide photographic material as described in the above (1), wherein said oil-soluble dye is a compound represented by the following general formula (II):

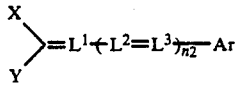

(II)

wherein X and Y each represents an electron attractive group or X and Y may be combined together to form an acid nucleus; Ar represents a phenyl group or a heterocyclic group; $L^1$, $L^2$ and $L^3$ each represents a methine group; and $n_2$ represents 0, 1 or 2.

(3) A further preferred embodiment of the invention is a silver halide photographic material as described in the above (1), wherein said oil-soluble dye is a compound represented by the following general formula (III):

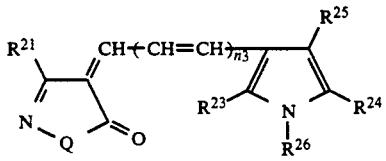

(III)

wherein $R^{21}$ represents a hydrogen atom, an alkyl group, an aryl group, $-COOR^{27}$, $-COR^{27}$, $-CONR^{27}R^{28}$, $-CN$, $-OR^{27}$, $-NR^{27}R^{28}$ or $-N(R^{27})COR^{28}$; Q represents an oxygen atom or $N\text{-}R^{22}$; $R^{22}$ represents a hydrogen atom, an alkyl group, an aryl group or a heterocyclic group; $R^{23}$, $R^{24}$ and $R^{25}$ each represents a hydrogen atom, an alkyl group or an aryl group or $R^{24}$ and $R^{25}$ may be combined together to form a six-membered ring; $R^{26}$ represents a hydrogen atom, an alkyl group, an aryl group or an amino group; $R^{27}$ and $R^{28}$ each represents a hydrogen atom, an alkyl group or an aryl group; and $n_3$ represents 0 or 1.

DETAILED DESCRIPTION OF THE INVENTION

Now, the present invention will be described in more detail below.

First, the water-soluble, organic solvent-soluble polymer including at least one repeating unit represented by general formula (I) will be described below.

In general formula (I), $R^1$ represents a hydrogen atom, a substituted or unsubstituted alkyl group having 1 to 4 carbon atoms (e.g., methyl, ethyl, n-butyl) or a halogen atom (e.g., chlorine atom, bromine atom) with a hydrogen atom and a methyl group being preferred.

$R^2$ and $R^3$ may be the same or different and each represents a substituted or unsubstituted alkyl group having 1 to 20 carbon atoms or a substituted or unsubstituted aryl group having 6 to 20 carbon atoms.

Examples of an unsubstituted alkyl group include a methyl group, an ethyl group, an n-propyl group, an isopropyl group, an n-butyl group, an isobutyl group, an n-amyl group, an n-hexyl group, a n-heptyl group, an n-octyl group, a 2-ethylhexyl group, an n-nonyl group, an n-decyl group, an n-dodecyl group and an n-octadecyl group.

Examples of suitable substituent groups for a substituted alkyl group and a substituted aryl group include an aryl group (e.g., phenyl group), a nitro group, a hydroxyl group, a cyano group, a sulfo group, an alkoxy group (e.g., methoxy group), an aryloxy group (e.g., phenoxy group), an acyloxy group (e.g., acetoxy group), an acylamino group (e.g., acetylamino group), a sulfonamido group (e.g., methanesulfonamido group), a sulfamoyl group (e.g., methylsulfamoyl group), a halogen atom (e.g., fluorine atom, chlorine atom, bromine atom), a carboxyl group, a carbamoyl group (e.g., methylcarbamoyl group), an alkoxycarbonyl group (e.g., methoxycarbonyl group) and a sulfonyl group (e.g., methylsulfonyl group). The substituted alkyl group and the substituted aryl group may optionally have two or more substituent groups which may be the same or different.

$R^2$ and $R^3$ may be combined together to form a ring together with the respective oxygen atoms bonded to $R^2$ and $R^3$ and the phosphorus atom shown in formula (I).

L represents a bivalent bonding group.

Examples of L include groups represented by the following general formula:

$$\left(L^1\right)_m\left(X^1\left(J^1-X^2\right)_p\left(J^2-X^3\right)_q\left(J^3\right)_r\right)_s$$

wherein $L^1$ represents —CON)$R^4$)— (wherein $R^4$ is a hydrogen atom, an unsubstituted alkyl group having 1 to 4 carbon atoms or a substituted alkyl group having 1 to 6 carbon atoms), —COO—, —NHCO—, —OCO—,

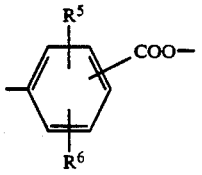

(wherein $R^5$ and $R^6$ are independently a hydrogen atom, a hydroxyl group, a halogen atom, a substituted or unsubstituted alkyl group having 1 to 12 carbon atoms, a substituted or unsubstituted alkoxy group having 1 to 12 carbon atoms, a substituted or unsubstituted acyloxy group having 1 to 12 carbon atoms or a substituted or unsubstituted aryloxy group having 6 to 12 carbon atoms) or

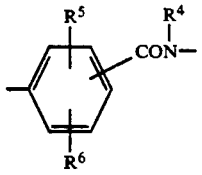

wherein $R^4$, $R^5$ and $R^6$ are as defined above.

$J^1$, $J^2$ and $J^3$ may be the same or different and each represents —CO—, —$SO_2$—, —CON($R^7$)— (wherein $R^7$ is a hydrogen atom, an unsubstituted alkyl group having 1 to 6 carbon atoms, a substituted alkyl group having 1 to 6 carbon atoms, —$SO_2$N($R^7$)— (wherein $R^7$ is as defined above), —N($R^7$)$R^8$— (wherein $R^7$ is as defined above, and $R^8$ is an alkylene group having 1 to 4 carbon atoms), —N($R^7$)—$R^8$—N($R^9$)— (wherein $R^7$ and $R^8$ are as defined above, and $R^9$ is a hydrogen atom, an unsubstituted alkyl group having 1 to 6 carbon atoms or a substituted alkyl group having 1 to 6 carbon atoms), —O—, —S—, —N($R^7$)—CO—N($R^9$)(wherein $R^7$ and $R^9$ are as defined above), —N($R^7$)—$SO_2$N($R^9$)— (wherein $R^7$ and $R^9$ are as defined above), —COO—, —OCO— or —N($R^7$)$CO_2$— (wherein $R^7$ is as defined above).

$X^1$, $X^2$ and $X^3$ may be the same or different and each represents an unsubstituted alkylene group having 1 to 20 carbon atoms, a substituted alkylene group having 1 to 20 carbon atoms, an unsubstituted arylene group having 6 to 20 carbon atoms, a substituted arylene group having 6 to 20 carbon atoms, an unsubstituted aralkylene group having 7 to 20 carbon atoms or a substituted aralkylene group having 7 to 20 carbon atoms. Examples of the alkylene group include methylene, methylmethylene, dimethylmethylene, dimethylene, trimethylene, tetramethylene, pentamethylene, hexamethylene and decylmethylene. An example of the aralkylene group is benzylidene. Examples of the phenylene group include p-phenylene, m-phenylene and methylphenylene.

m, p, q, r and s each represents 0 or 1.

Among the above-described repeating units of general formula (I), the units wherein $n_1$ is 1 and L is an alkylene or arylene group which is bonded to a hetero atom (e.g., oxygen, nitrogen) are particularly preferred.

Preferred examples of the repeating units of general formula (I) include, but are not limited to, repeating units derived from the following monomers.

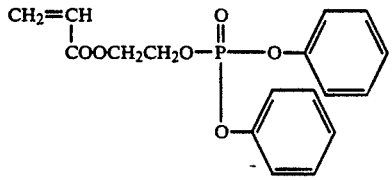

M-1

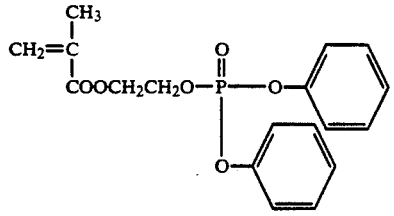

M-2

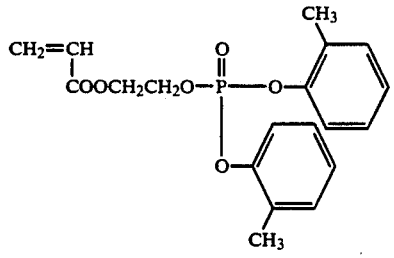

M-3

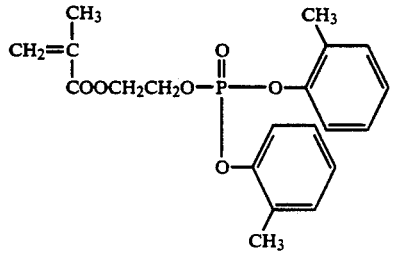

M-4

-continued
M-5
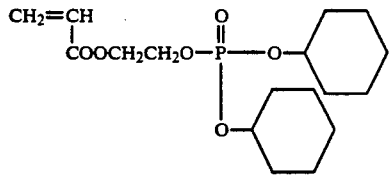
M-6
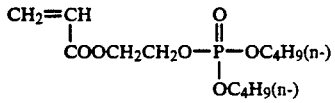
M-7
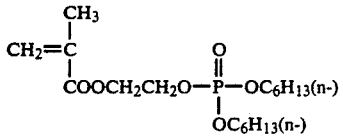
M-8
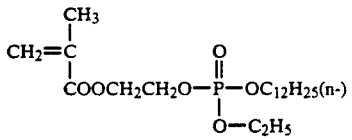
M-9
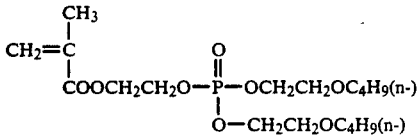
M-10
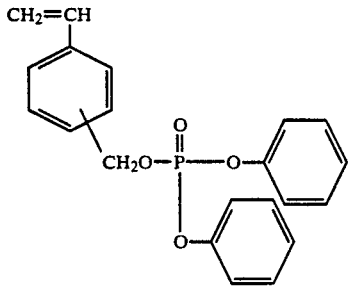
M-11
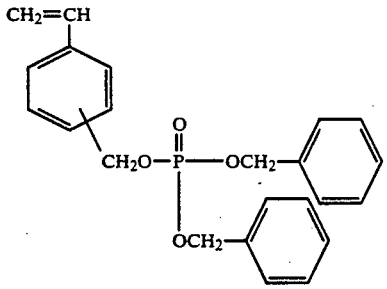
M-12
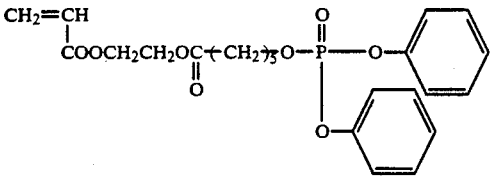
-continued
M-13
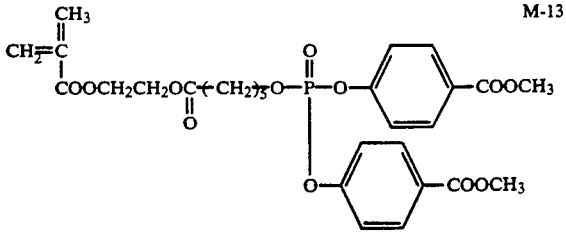
M-14
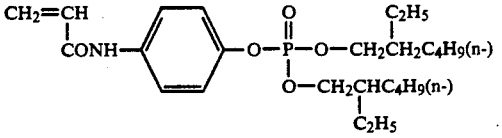
M-15
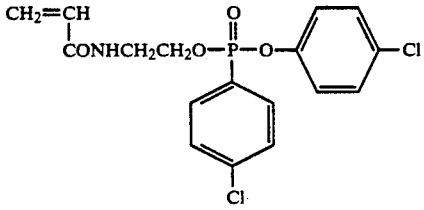
M-16
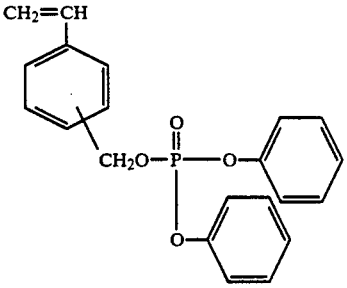
M-17
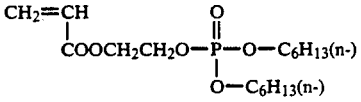
M-18
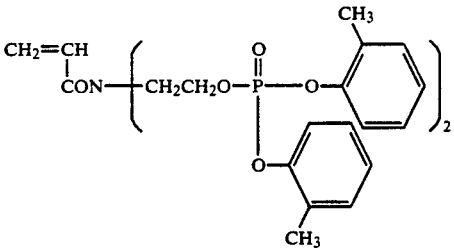
M-19
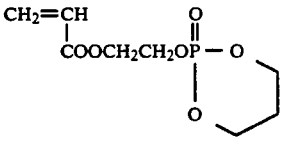
M-20
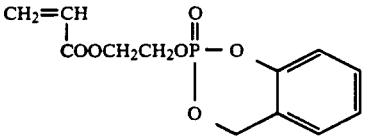

The water-insoluble, organic solvent soluble polymers of the present invention may be polymers composed solely of the repeating units of general formula (I) or they may be copolymers of the repeating units of general formula (I) with other ethylenically unsaturated monomers.

Examples of the so-called other ethylenically unsaturated monomers include acrylic esters such as methyl acrylate, ethyl acrylate, n-propyl acrylate, isopropyl acrylate, n-butyl acrylate, isobutyl acrylate, sec-butyl acrylate, tert-butyl acrylate, amyl acrylate, hexyl acrylate, 2-ethylhexyl acrylate, octyl acrylate, tert-octyl acrylate, 2-chloroethyl acrylate, 2-bromoethyl acrylate, 4-chlorobutyl acrylate, cyanoethyl acrylate, 2-acetoxyethyl acrylate, dimethylaminoethyl acrylate, benzyl acrylate, methoxybenzyl acrylate, 2-chlorocyclohexyl acrylate, cyclohexyl acrylate, furfuryl acrylate, tetrahydrofurfuryl acrylate, phenyl acrylate, 5-hydroxypentyl acrylate, 2,2-dimethyl-3-hydroxypropyl acrylate, 2-methoxyethyl acrylate, 3-methoxybutyl acrylate, 2-ethoxyethyl acrylate, 2-isopropoxyethyl acrylate, 2-butoxyethyl acrylate, 2-(2-methoxyethoxy) ethyl acrylate, 2-(2-butoxyethoxy)ethyl acrylate, ω-methoxypolyethylene glycol acrylate (moles of addition: n=9), 1-bromo-2-methoxyethyl acrylate and 1,1-dichloro-2-ethoxyethyl acrylate; methacrylic esters such as methyl methacrylate, ethyl methacrylate, n-propyl methacrylate, isopropyl methacrylate, n-butyl methacrylate, isobutyl methacrylate, sec-butyl methacrylate, tert-butyl methacrylate, amyl methacrylate, hexyl methacrylate, cyclohexyl methacrylate, benzyl methacrylate, chlorobenzyl methacrylate, octyl methacrylate, stearyl methacrylate, sulfopropyl methacrylate, N-ethyl-N-phenylaminoethyl methacrylate, 2-(3-phenylpropyloxy)ethyl methacrylate, dimethylaminophenoxyethyl methacrylate, furfuryl methacrylate, tetrahydrofurfuryl methacrylate, phenyl methacrylate, cresyl methacrylate, naphthyl methacrylate, 2-hydroxyethyl methacrylate, 4-hydoxybutyl methacrylate, triethylene glycol monomethacrylate, dipropylene glycol monomethacrylate, 2-methoxyethyl methacrylate, 3-methoxybutyl methacrylate, 2-acetoxyethyl methacrylate, 2-acetoacetoxyethyl methacrylate, 2-ethoxyethyl methacrylate, 2-isopropoxyethyl methacrylate, 2-butoxyethyl methacrylate, 2-(2-methoxyethoxy)ethyl methacrylate, 2-(2-ethoxyethoxy)ethyl methacrylate, 2-(2-butoxyethoxy)ethyl methacrylate, ω-methoxypolyethylene glycol methacrylate (moles of addition: n=6), allyl methacrylate and dimethylaminoethyl methacrylate methylchloride; vinyl esters such as vinyl acetate, vinyl propionate, vinyl butyrate, vinyl isobutyrate, vinyl caproate, vinyl chloroacetate, vinyl methoxyacetate, vinyl phenylacetate, vinyl benzoate and vinyl salicylate; acrylamides such as acrylamide, methyl acrylamide, ethyl acrylamide, propyl acrylamide, butyl acrylamide, tert-butyl acrylamide, cyclohexyl acrylamide, benzyl acrylamide, hydroxymethyl acrylamide, methoxyethyl acrylamide, dimethylaminoethyl acrylamide, phenyl acrylamide, dimethyl acrylamide, diethyl acrylamide, β-cyanoethyl acrylamide, N-(2-acetoacetoxy)ethyl acrylamide and diacetone acrylamide; methacrylamides such as methacrylamide, methyl methacrylamide, ethyl methacrylamide, propyl methacrylamide, butyl methacrylamide, tert-butyl methacrylamide, cyclohexyl methacrylamide, benzyl methacrylamide, hydroxymethyl methacrylamide, methoxyethyl methacrylamide, dimethylaminoethyl methacrylamide, phenyl methacrylamide, dimethyl methacrylamide, diethyl methacrylamide, β-cyanoethyl methacrylamide and N-(2-acetoacetoxyethyl)methacrylamide; olefins such as dicyclopentadiene, ethylene, propylene, 1-butene, 1-pentene, vinyl chloride, vinylidene chloride, isoprene, chloroprene, butadiene and 2,3-dimethylbutadiene; styrene compounds such as methylstyrene, dimethylstyrene, trimethylstyrene, ethylstyrene, isopropylstyrene, chloromethylstyrene, methoxystyrene, acetoxystyrene, chlorostyrene, dichlorostyrene, bromostyrene and methyl vinylbenzoate; vinyl ethers such as methyl vinyl ether, butyl vinyl ether, hexyl vinyl ether, methoxyethyl vinyl ether and dimethylaminoethyl vinyl ether; and other monomers such as butyl crotonate, hexyl crotonate, dimethyl itaconate, dibutyl itaconate, diethyl maleate, dimethyl maleate, dibutyl maleate, diethyl fumarate, dimethyl fumarate, dibutyl fumarate, methyl vinyl ketone, phenyl vinyl ketone, methoxyethyl vinyl ketone, glycidyl acrylate, glycidyl methacrylate, N-vinyloxazolidone, N-vinylpyrrolidone, acrylonitrile, methacrylonitrile, methylenemalonitrile and vinylidene chloride.

Further, in the preparation of the water-insoluble, organic solvent-soluble polymers of the present invention, a monomer having an acid group can be copolymerized with a monomer having a repeating group of general formula (I) to accelerate the decolorizability of the dyes. Examples of monomers having an acid group include acrylic acid, methacrylic acid, itaconic acid, maleic acid, monoalkylene itaconates (e.g., monomethyl itaconate, monoethyl itaconate), monoalkyl maleates (e.g., monomethyl maleate, monoethyl maleate), citraconic acid, styrenesulfonic acid, vinylbenzenesulfonic acid, vinylsulfonic acid, acryloyloxyalkylsulfonic acids (e.g., acryloyloxymethylsulfonic acid, acryloyloxyethylsulfonic acid, acryloyloxypropylsulfonic acid), methacryloyloxyalkylsulfonic acids (e.g., methacryloyloxymethylsulfonic acid, methacryloyloxyethylsulfonic acid, methacryloyloxypropylsulfonic acid), acrylamidoalkylsulfonic acids (e.g., 2-acrylamido-2-methylethanesulfonic acid, 2-acrylamido-2-methylpropanesulfonic acid, 2-acrylamido-2-methylbutanesulfonic acid), and methacrylamidoalkylsulfonic acids (e.g., 2-methacrylamido-2-methylethanesulfonic acid, 2-methacrylamido-2-methylpropanesulfonic acid, 2-methacrylamido-2-methylbutanesulfonic acid).

There is a possibility that copolymerization of a monomer having an acid group with a monomer having a repeating unit of general formula (I) may cause widening of the hue and lowering of the maximum absorption wavelength depending on the types of the dyes used. As monomers which scarcely cause a change in hue and accelerate decolorizability, there are particularly preferred compounds which give homopolymers which are insoluble in water at a pH<6, but are soluble in water at a pH>10. Examples of such hydrophobic monomers having an acid group include the following compounds:

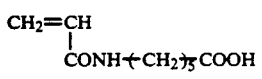

S-1

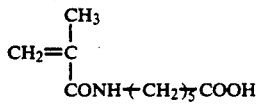

S-2

-continued
S-3
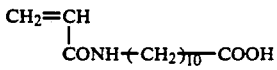
S-4
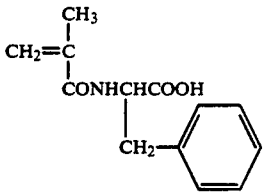
S-5
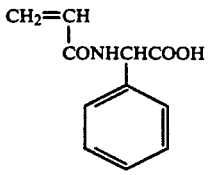
S-6
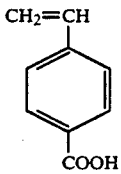
S-7
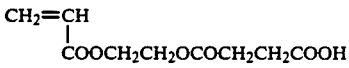
S-8
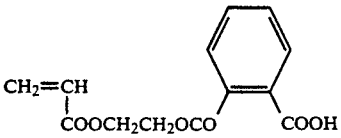
S-9
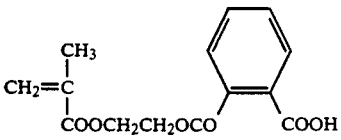
S-10
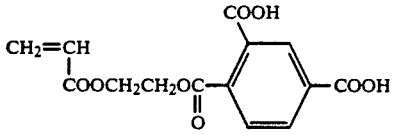
S-11
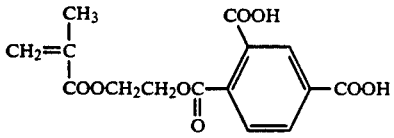
S-12
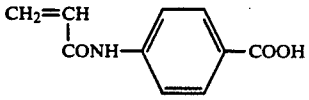
S-13
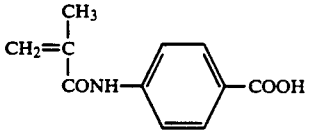
-continued
S-14
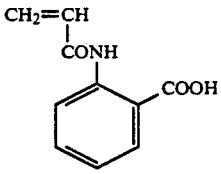
S-15
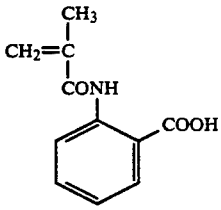
S-16
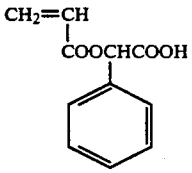
S-17
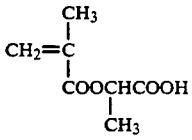
S-18
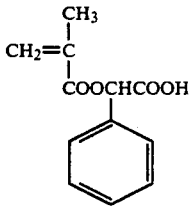
S-19
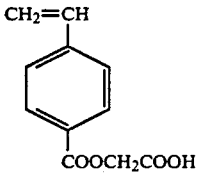
S-20
$H_{17}C_8OOCCH{=}CHCOOH$
S-21
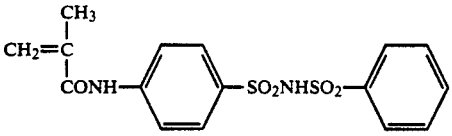
S-22
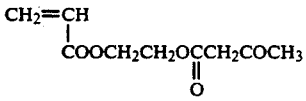
S-23
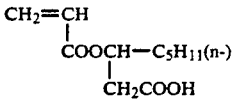

The above-described acids may be in the form of an alkali metal salt (e.g., Na or K salt) or an ammonium ion salt.

The optimum range of the proportion of the repeating unit of general formula (I) in the water-insoluble, organic solvent-soluble polymer of the present invention varies depending on the type of the dye to be used and the mixing ratio of the dye and the polymer, but is preferably 30 to 100% by weight, particularly preferably 50 to 100% by weight. When one or more comonomers are used in addition to the monomers from which the repeating units of general formula (I) are derived, there is no particular limitation with regard to the amounts of the comonomers, so long as water-soluble copolymers are not formed. However, the proportion of the comonomers in the polymer is preferably 0 to 70% by weight, particularly preferably 0 to 50% by weight. When the use of the comonomers is essentical, the proportion of the lower limit thereof is 3% by weight.

When one or more monomers having an acid group are used as comonomers for the copolymers, the total amount of the comonomers will vary depending on the type of the dye to be used, the mixing ratio of the dye and the polymer and the polarity of the comonomer having an acid group, but the total amount is preferably 0 to 30% by weight, particularly preferably 0 to 15% by weight when the comonomers having an acid group are hydrophilic, and preferably 0 to 70% by weight, particularly preferably 0 to 50% by weight when the comonomers having an acid group are hydrophobic. When the user of the comonomers is essential, the proportion of the lower limit thereof is 3% by weight.

Examples of the water-insoluble, organic solvent-soluble polymer which can be used in the present invention include, but are not limited to, the following polymers. Parenthesized numerals represent the ratio of components (percentage by weight) and a number-average molecular weight (Mn).

| | |
|---|---|
| P-1 | M-1 homopolymer (100, Mn = 18,000) |
| P-2 | M-2 homopolymer (100, Mn = 19,000) |
| P-3 | M-3 homopolymer (100, Mn = 6,500) |
| P-4 | M-5 homopolymer (100, Mn = 75,000) |
| P-5 | M-12 homopolymer (100, Mn = 33,000) |
| P-6 | M-14 homopolymer (100, Mn = 17,000) |
| P-7 | M-1/M-2 copolymer (50/50, Mn = 44,000) |
| P-8 to 10 | M-1/methyl methacrylate copolymer (x/y, Mn)<br>P-8 x/y = 90/10, Mn = 15,000<br>P-9 x/y = 70/30, Mn = 20,000<br>P-10 x/y = 50/50, Mn = 24,000 |
| P-11 | M-2/methyl methacrylate copolymer (80/20, Mn = 27,000) |
| P-12 and 13 | M-1/acrylic acid copolymer (x/y, Mn)<br>P-12 x/y = 95/5, Mn = 14,000<br>P-13 x/y = 90/10, Mn = 12,000 |
| P-14 | M-2/methacrylic acid copolymer (95/5, Mn = 27,000) |
| P 15 | M-1/S-14 copolymer (70/30, Mn = 8,500) |
| P-16 to 18 | M-1/S-15 copolymer (x/y, Mn)<br>P-16 x/y = 90/10, Mn = 19,000<br>P-17 x/y = 70/30, Mn = 17,000<br>P-18 x/y = 50/50, Mn = 16,000 |
| P-19 | M-2/S-15 copolymer (70/30, Mn = 24,000) |
| P-20 | M-10/butyl acrylate/S-13 copolymer (60/20/20, Mn = 61,000) |
| P-21 | M-11/methyl acrylate/sodium 2-acrylamido-2-methylpropanesulfonate copolymer (60/37/3, Mn = 95,000) |
| P-22 | M-2/M-10/methyl methacrylate/dodecyl methacrylate copolymer (50/10/30/10, Mn = 11,000) |
| P-23 | M-4/benzyl methacrylate/S-8 copolymer (60/30/10, Mn = 14,000) |

-continued

| | |
|---|---|
| P-24 | M-3/cyclohexyl methacrylate/2-hydroxyethyl methacrylate copolymer (50/30/20, Mn = 35,000) |
| P-25 | M-1/butyl acrylate copolymer (60/40, M = 48,000) |
| P-26 | M-16/ethyl methacrylate copolymer (50/50, Mn = 33,000) |
| p-27 | M-2/M-20/butyl methacrylate/S-18 copolymer (40/20/20/20, Mn = 25,000) |
| P-28 | M-18/t-butyl acrylaide/methyl acrylate copolymer (60/20/20. Mn = 12,000) |
| P-29 | M-1/butyl acrylate/N-acryloylmorpholine copolymer (50/40/10, Mn = 3,800) |
| P-30 | M-19/methyl methacrylate/S-3 copolymer (70/25/5, Mn = 15,000) |

The above-described polymers of the present invention may be used in a combination of two or more of them. The effect of the present invention is substantially not so greatly affected by the molecular weights and degrees of polymerization of the polymers of the present invention. However, with an increase in the molecular weight of the polymer, a problem occurs in that much time is required to dissolve the polymer in a co-solvent. Further, since the viscosity of the solution of the polymer is high, the polymer solution is difficult to emulsify and disperse, and coarse particles are formed. As a result, problems such as that the absorption characteristics of the dyes deteriorate and coatability becomes poor, are apt to occur. When the viscosity of the solution is lowered by using a large amount of co-solvents to solve the above problems, another problem with regard to the process occurs. When the above factors are taken into consideration, the viscosity of the polymer solution formed by dissolving 30 g of the polymer in 100 cc of a co-solvent is preferably not higher than 5,000 cps, more preferably not higher than 2,000 cps. The polymers which can be used in the present invention have a number-average molecular weight of preferably not more than 300,000, particularly preferably not more than 100,000.

The ratio of the polymer of the present invention to the co-solvent used varies depending on the types of the polymers to be used and varies widely depending on the solubility of the polymers in the co-solvent, the degrees of polymerization of the polymers, and the solubility of the dyes. Usually, the co-solvent is used in such an amount that a solution of at least the dye and the polymer in the co-solvent has a sufficiently low viscosity to allow the solution to be easily dispersed in an aqueous solution of a hydrophilic colloid. The higher the degree of polymerization of the polymer, the higher the viscosity of the solution. Accordingly, the ratio of the polymer to the co-solvent can not be definitely determined irrespectively of the types of the polymers. However, the ratio of the polymer to the co-solvent is usually in the range of preferably from about 1:1 to 1:50 by weight. The ratio by weight of the polymer of the present invention to the dye is in the range of preferably from 1:20 to 20:1, more preferably from 1:10 to 10:1.

The oil-soluble dyes of the present invention will be described below.

Any conventional dye can be used in the present invention. Examples of the structures of dyes which can be used in the present invention include arylidene compounds, heterocyclic arylidene compounds, anthraquinones, triarylmethanes, azomethine dyes, azo dyes, cyanine dyes, merocyanine dyes, oxonol dyes, styryl dyes, phthalocyanines and indigo dyes.

It is preferred that the dye of the present invention be insoluble in water and have a solubility of at least 10 g/l (at 40° C.) in ethyl acetate. The structure of the chromophore is not critical.

Arylidene compounds are those compounds wherein an acid nucleus and an aryl group are bonded to each other through one or more methine groups.

Examples of the acid nucleus include 2-pyrazolidone-5-one, 2-isoxazoline-5-one, barbituric acid, 2-thiobarbituric acid, benzoylacetonitrile, cyanoacetamide, cyanoacetanilide, cyanoacetic esters, malonic esters, malondianilide, dimedone, benzoylacetanilide, pivaloylacetanilide, malononitrile, 1,2-dihydro-6-hydroxypyridine-2-one, pyrazolidine-3,5-dione, pyrazolo[3,4-b]pyridine-3,6-dione, indane-1,3-dione, hydantoin, thiohydantoin and 2,5-dihydrofuran-2-one.

An example of the aryl group is a phenyl group which is preferably substituted by an electron donative group such as an alkoxy group, a hydroxy group or an amino group.

Heterocyclic arylidene compounds are those compounds where an acid nucleus and a heteroaromatic ring are bonded to each other through one or more methine groups.

Examples of the acid nucleus include those described above.

Examples of the heteroaromatic ring include pyrrole, indole, furan, thiophene, pyrazole and coumarin.

Anthraquinones are those compounds where anthraquinone is substituted by an electron donative group or an electron attractive group.

Triarylmethanes are those compounds where three substituted aryl groups (which may be the same or different) are bonded to one methine group. An example of a triarylmethane is phenolphthalein.

Azomethine dyes are those compounds wherein an acid nucleus and an aryl group are bonded to each other through a nitrogen-containing unsaturated bonding group (an azomethine group). Examples of the acid nucleus include those described above and those conventionally used for photographic couplers. Indoaniline compounds are a subset of the azomethine dyes.

Azo dyes are those compounds wherein aryl groups or heteroaromatic groups are bonded to each other through an azo group.

Cyanine dyes are those compounds wherein two basic nuclei are bonded to each other through one or more methine groups. Examples of basic nuclei include quaternary salts of oxazole, benzoxazole, thiazole, benzthiazole, benzimidazole, quinoline, pyridine, indolenine, benzindolenine, benzoselenazole and imidazoquinoxaline, and pyrylium salts.

Merocyanine dyes are those compounds wherein a basic nucleus and an acid nucleus are bonded to each other through a double bond or at least one methine group.

Oxonol dyes are those compounds wherein two acid nuclei are bonded to each other through one, three or more odd-numbered methine groups.

Styryl dyes are those compounds wherein a basic nucleus and an aryl group are bonded to each other through two or four methine groups.

Phthalocyanine may be coordinated with a metal, or may not be coordinated with a metal.

Indigo may be substituted or unsubstituted and includes thioindigo.

It is necessary that the dyes of the present invention be decolorized and/or dissolved out by photographic processing. Accordingly, it is preferred that the dyes have a dissociable group. A carboxyl group and a hydroxyl group are preferred dissociable groups. However, particularly preferred dissociable groups include a sulfonamido group, a sulfamoyl group, an acylsulfamoyl group, a sulfonylcarbamoyl group and a sulfonimido group.

The dyes which can be preferably used in the present invention are compounds represented by general formula (II).

The dyes of general formula (II) will be described in more detail below.

Examples of the electron attractive group represented by X and Y include a cyano group, a nitro group, an alkoxycarbonyl group (e.g., methoxycarbonyl, ethoxycarbonyl, hydroxyethoxycarbonyl, t-amyloxycarbonyl), an aryloxycarbonyl group (e.g., phenoxycarbonyl, 4-methoxycarbonyl), an acyl group (e.g., acetyl, pivaloyl, benzoyl, propionyl, 4-methanesulfonamidobenzoyl, 4-methoxy-3-methanesulfonamidobenzoyl, 1-methylcyclopropylcarbonyl), a carbamoyl group (e.g., N-ethylcarbamoyl, N,N-dimethylcarbamoyl, piperidine-1-ylcarbamoyl, N-(3-methanesulfonamidophenyl)carbamoyl) and a sulfonyl group (e.g., benzenesulfonyl, p-toluenesulfonyl). The acid nucleus formed by combining X and Y is preferably a five-membered or six-membered ring. Preferred examples of the five-membered ring include 2-pyrazoline-5-one, 2-isoxazoline-5-one, pyrazolidine-3,5-dione, 2,5-dihydrofuran-2-one and indane-1,3-dione. Preferred examples of the six-membered ring include 1,2-dihydro-6-hydroxypyridine-2-one, barbituric acid and thiobarbituric acid.

The phenyl group represented by Ar is preferably a phenyl group substituted by an electron donative group. Preferred examples of the electron donative group include a dialkylamino group (e.g., dimethylamino, di(ethoxycarbonylmethyl)amino, di(butoxycarbonylmethyl)amino, N-ethyl-N-ethoxycarbonylmethylamino, di(cyanoethyl)amino, peridinyl, pyrrolidinyl, morpholino, N-ethyl-N-$\beta$-methanesulfonamidoethylamino, N-ethyl-N-$\beta$-hydroxyethyl), a hydroxy group and an alkoxy group (e.g., methoxy, ethoxy, ethoxycarbonylmethoxy).

The heterocyclic group represented by Ar is preferably a five-membered heterocyclic ring. Pyrrole, indole, furan and thiophene are particularly preferred.

The methine group represented by $L^1$, $L^2$ and $L^3$ may be substituted or unsubstituted. However, an unsubstituted methine group is preferable.

Dyes which can be particularly preferably used in the present invention are compounds of general formula (III). The dyes of general formula (III) will be described in more detail below.

The alkyl group represented by $R^{21}$ is preferably an alkyl group having 1 to 8 carbon atoms such as methyl, ethyl, propyl, t-butyl, n-butyl, 1-methylcyclopropyl, chloromethyl, trifluoromethyl or ethoxycarbonylmethyl.

The aryl group represented by $R^{21}$ is preferably an aryl group having 6 to 13 carbon atoms such as phenyl, 4-methoxyphenyl, 4-acetylaminophenyl, 4-methanesulfonamidophenyl or 4-benzenesulfonamidophenyl.

The alkyl group represented by $R^{22}$ is preferably an alkyl group having 1 to 18 carbon atoms such as methyl, 2-cyanoethyl, 2-hydroxyethyl or 2-acetoxyethyl.

The aryl group represented by $R^{22}$ is preferably an aryl group having 6 to 22 carbon atoms such as phenyl, 2-methoxy-5-ethoxycarbonylphenyl, 3,5-di(ethoxycarbonyl)phenyl, 4-di(ethoxycarbonylmethyl)aminocarbonylphenyl, 4-n-octyloxycarbonylphenyl, 4-butanesulfonamidocarbonylphenyl, 4-methanesulfonamidocarbonylphenyl, 3-sulfamoylphenyl, 4-methanesulfonamidophenyl, 4-methanesulfonamidosulfonphenyl, 4-acetylsulfamoylphenyl, 4-propionylsulfamoylphenyl or 4-N-ethylcarbamoylsulfamoylphenyl.

Examples of the heterocyclic group represented by $R^{22}$ include pyridyl, 4-hydroxy-6-methylpyrimidine-2-yl, 4-hydroxy-6-t-butylpyrimidine-2-yl and sulfolane-3-yl.

The alkyl group represented by $R^{23}$, $R^{24}$ and $R^{25}$ is preferably an alkyl group having 1 to 6 carbon atoms such as methyl, ethyl or propyl with a methyl group being particularly preferred.

The aryl group represented by $R^{23}$, $R^{24}$ and $R^{25}$ is preferably an aryl group having 6 to 13 carbon atoms with a phenyl group being particularly preferred.

The six-membered ring formed by $R^{24}$ and $R^{25}$ may be a saturated, unsaturated, or heterocyclic ring. A benzene ring is particularly preferred.

The alkyl group represented by $R^{26}$ is preferably an alkyl group having 1 to 18 carbon atoms such as methyl, ethyl, ethoxycarbonylmethyl, t-butoxycarbonylmethyl, ethoxycarbonylethyl, dimethylaminomethyl, 2-cyanoethyl, 3-acetamidopropyl, 3-propionylaminopropyl, 3-benzenesulfonamidopropyl or 3-propanesulfonamidopropyl.

The aryl group represented by $R^{26}$ is preferably an aryl group having 6 to 22 carbon atoms such as phenyl, 2-methoxy-5-ethoxycarbonylphenyl, 4-di(ethoxycarbonylmethyl)aminocarbonylphenyl, 4-n-octyloxycarbonylphenyl, 4-hydroxyethoxycarbonylphenyl, 4-propanesulfonamidophenyl, 4-butanesulfonamidocarbonylphenyl, 4-methanesulfonamidocarbonylphenyl, phenyl or 4-methanesulfonamidophenyl.

The amino group represented by $R^{26}$ is preferably a dialkylamino group such as dimethylamino or diethylamino.

The alkyl group represented by $R^{27}$ and $R^{28}$ is preferably an alkyl group having 1 to 12 carbon atoms such as methyl, ethyl, octyl, dodecyl, cyclohexyl, ethoxycarbonylmethyl, ethoxycarbonylethyl, 2-hydroxyethyl, 2-ethoxyethyl, 2-methanesulfonamidoethyl, cyanoethyl, 2,2,3,3-tetrafluoropropyl, chloroethyl, bromoethyl, acetoxyethyl or dimethylaminoethyl.

The aryl group represented by $R^{27}$ and $R^{28}$ is preferably an aryl group having 6 to 12 carbon atoms such as phenyl, 4-methoxyphenyl or 3-methylphenyl.

It is preferred that the compounds of general formula (III) do not have a sulfo group in the free form or in the form of a salt or a carboxyl group in the form of a salt as substituent groups.

It is preferred that the compounds of general formula (III) have a dissociable group in addition to the above-described groups. Preferred examples of the dissociable group include a sulfonamido group, a sulfamoyl group, an acylsulfamoyl group, a sulfonylcarbamoyl group, a sulfonimido group, a carbamoylsulfamoyl group and a carboxyl group.

Examples of the dyes which can be used in the present invention include, but are not limited to, the following compounds:

D-1

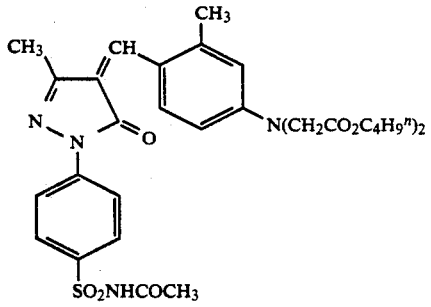

D-2

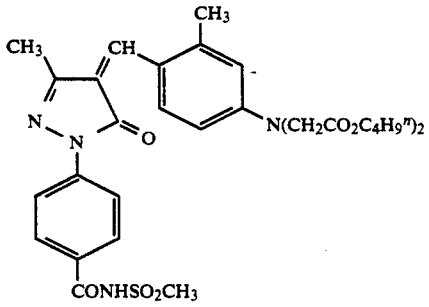

D-3

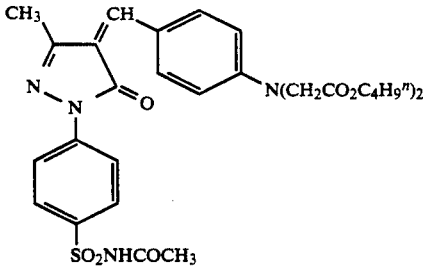

D-4

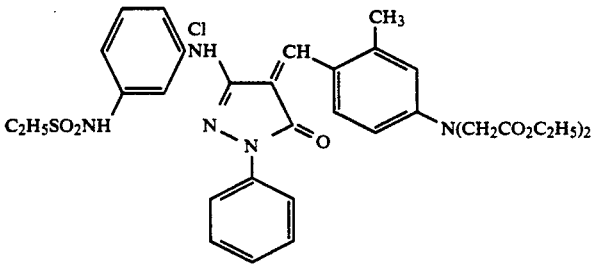

-continued
D-5
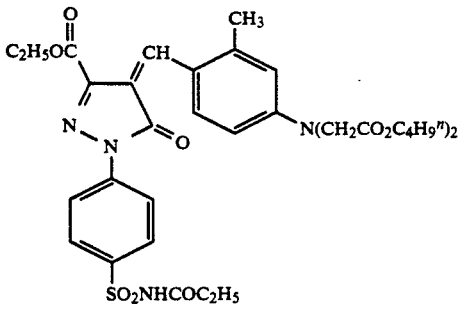
D-6
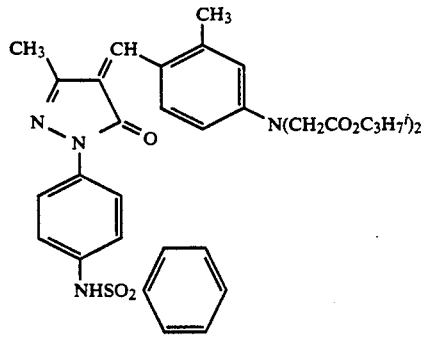
D-7
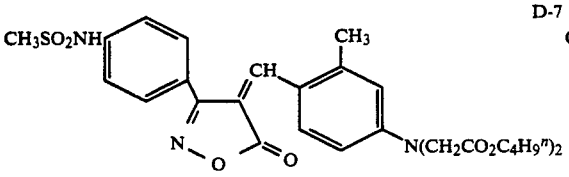
D-8
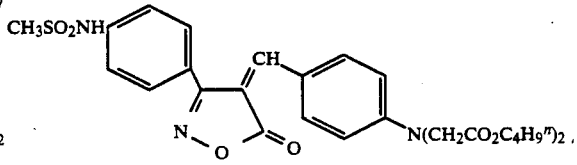
D-9
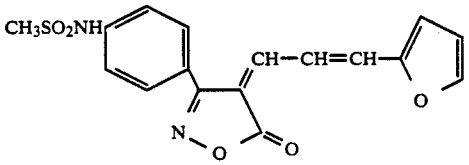
D-10
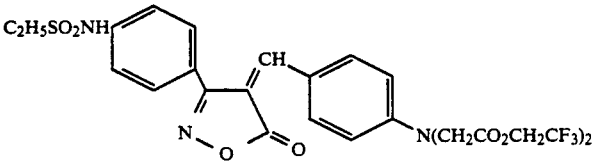
D-11
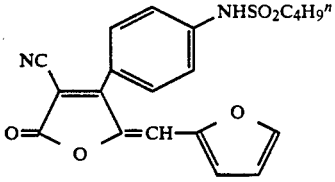
D-12
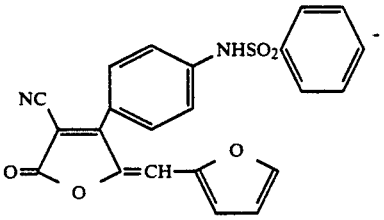
D-13
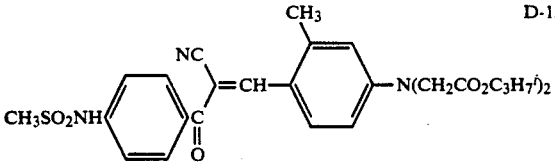
D-14
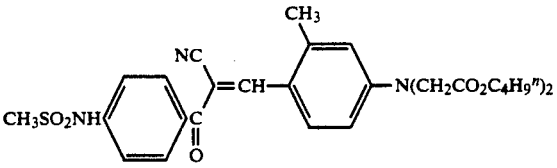
D-15
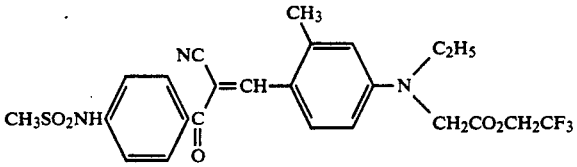
D-16
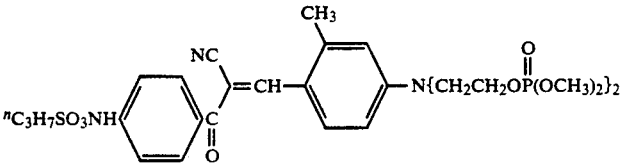

-continued
D-17
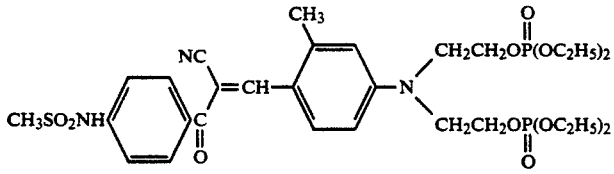
D-18
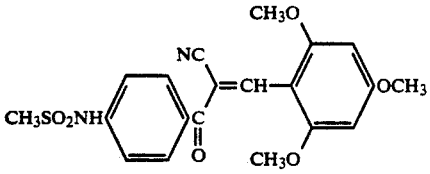
D-19
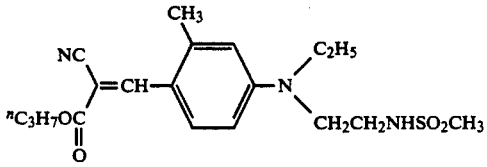
D-20
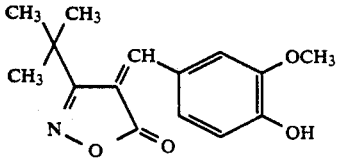
D-21
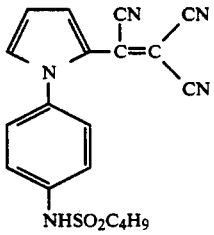
D-22
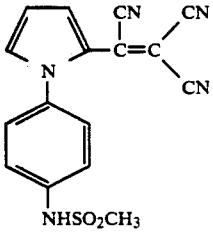
D-23
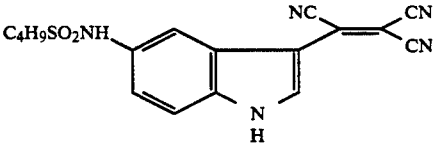
D-24
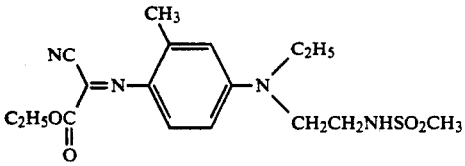
D-25
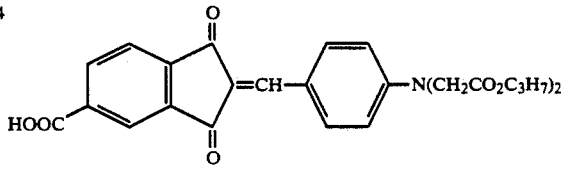
D-26
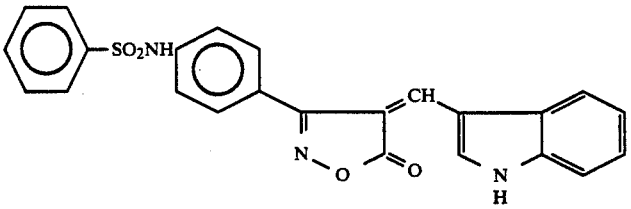
D-27
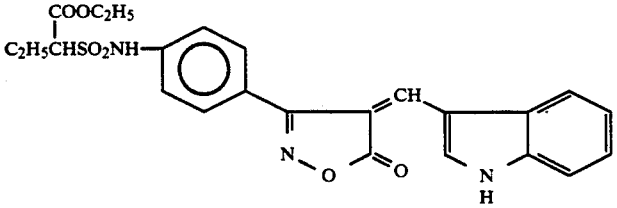

-continued
D-28
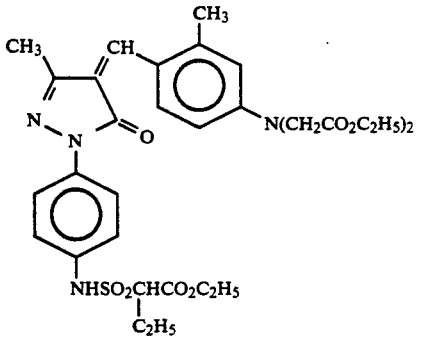
D-29
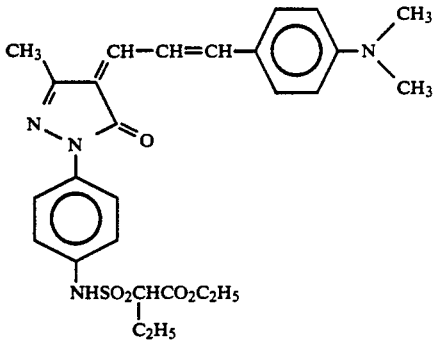
D-30
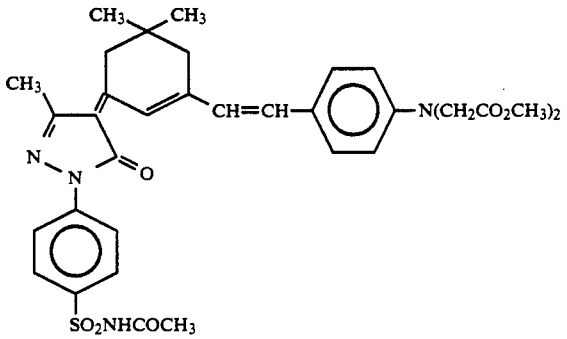
D-31
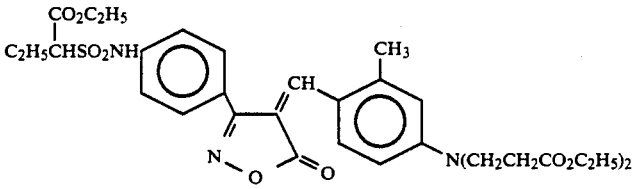
D-32
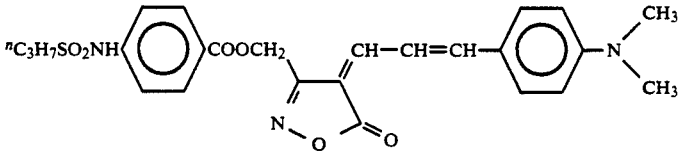
D-33
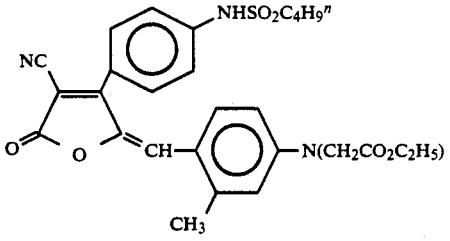
D-34
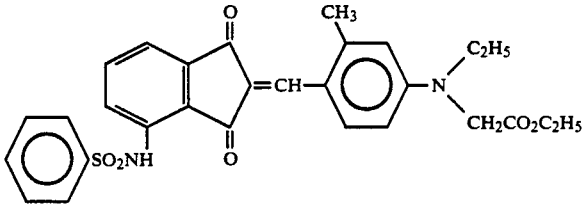

-continued
D-35
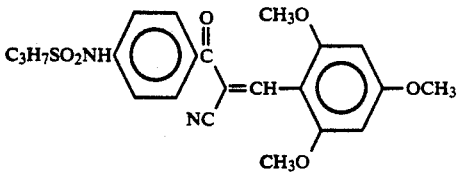
D-36
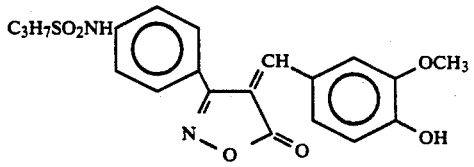
D-37
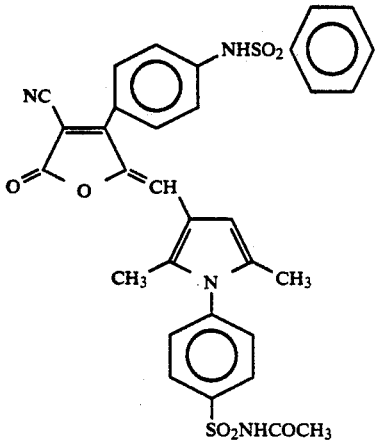
D-38
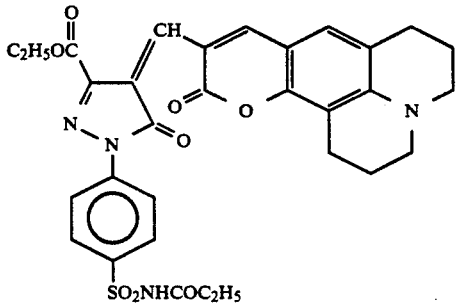
D-39
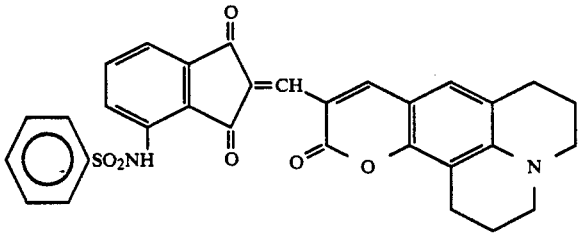
D-40
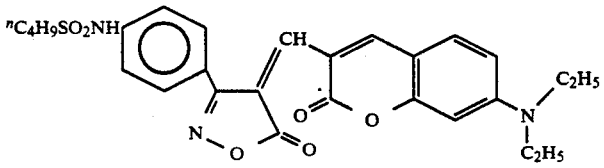
D-41
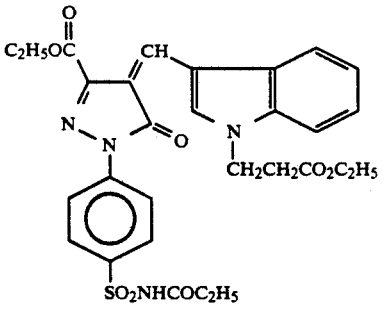
D-42
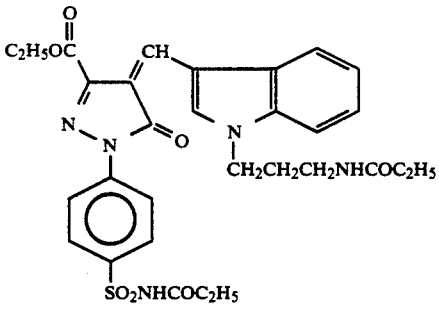
D-43
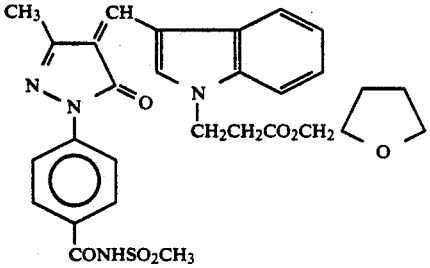
D-44
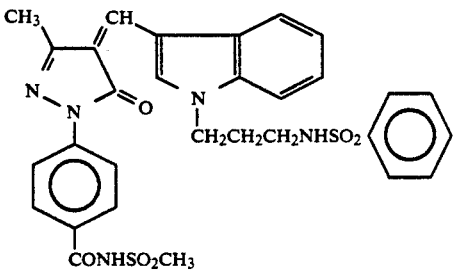

-continued
D-45
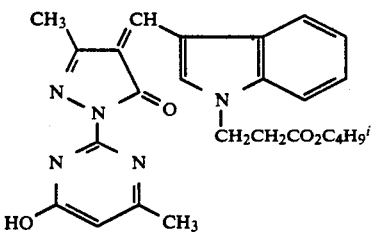
D-46
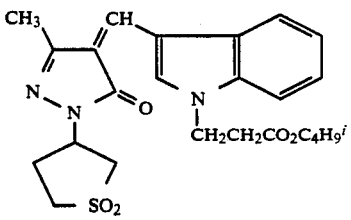
D-47
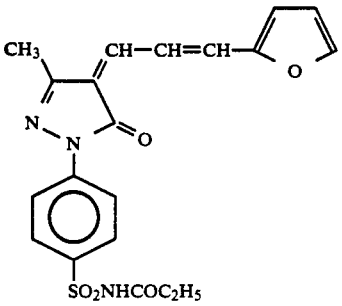
D-48
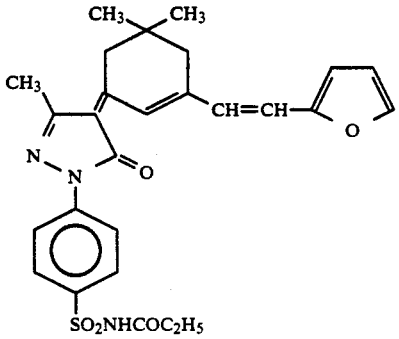
D-49
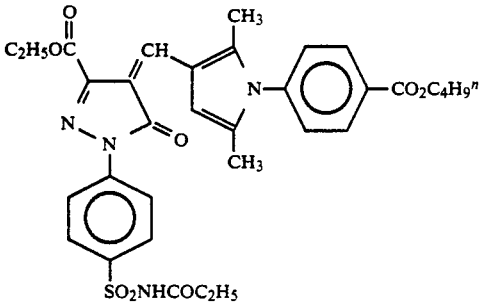
D-50
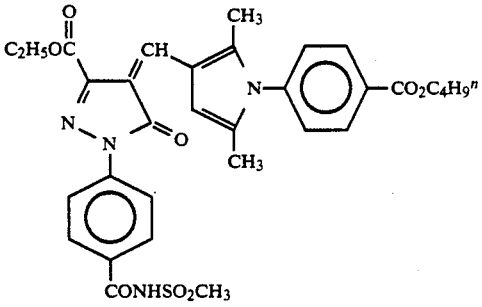
D-51
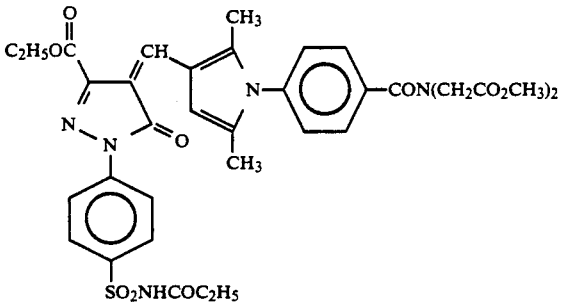
D-52
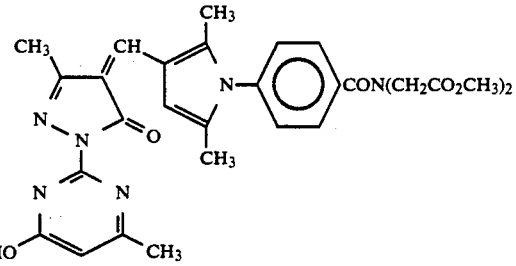
D-53
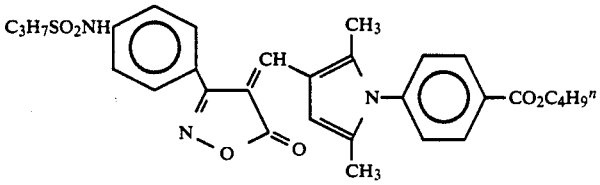

-continued
D-54
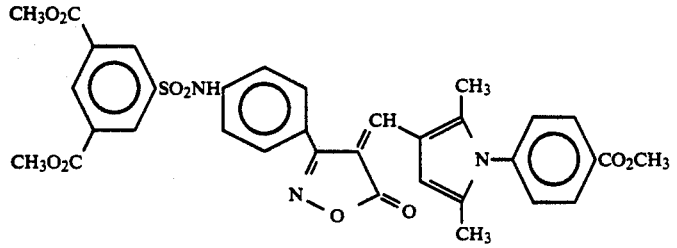
D-55
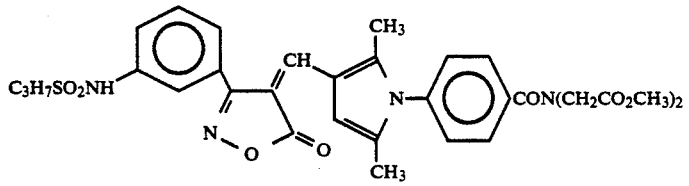
D-56
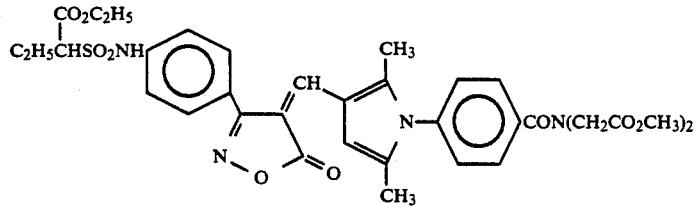
D-57
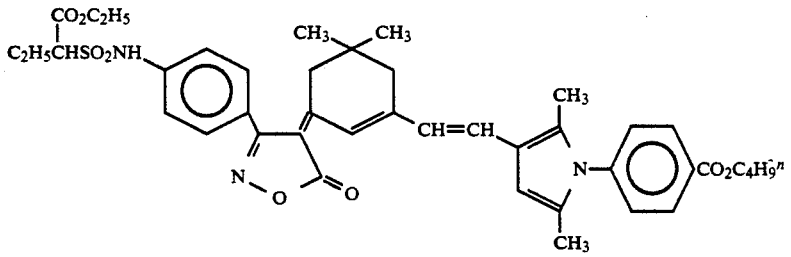
D-58
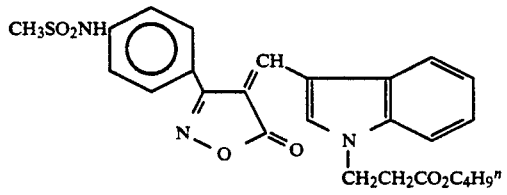
D-59
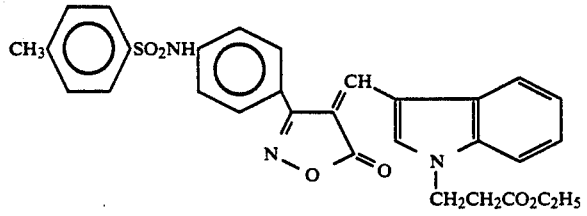
D-60
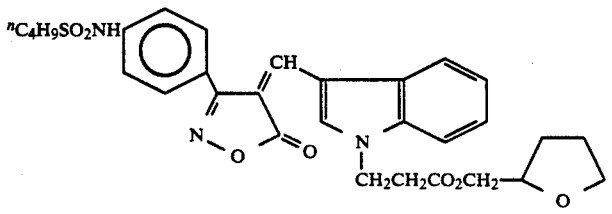

-continued
D-61
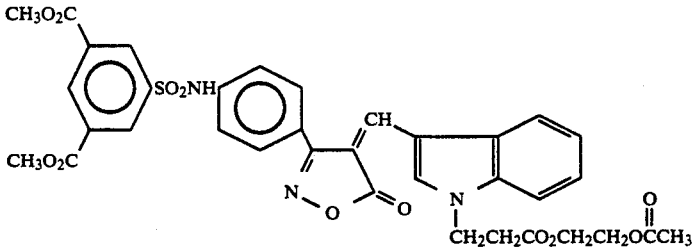
D-62
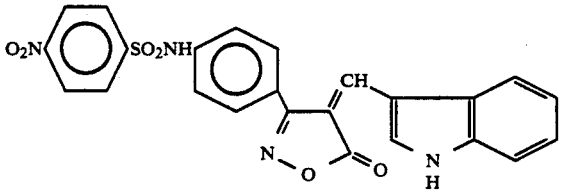
D-63
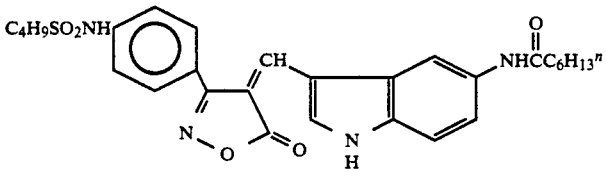
D-64
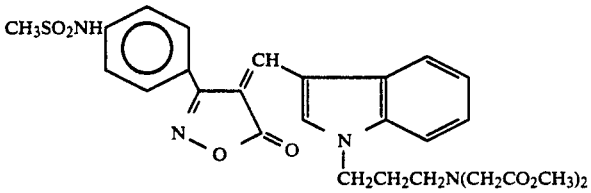
D-65
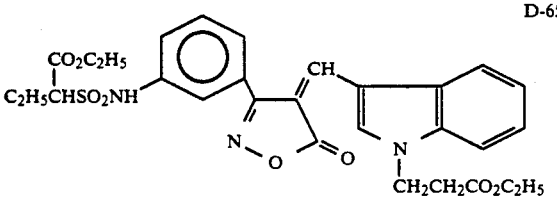
D-66
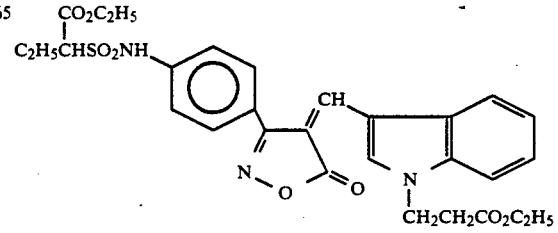
D-67
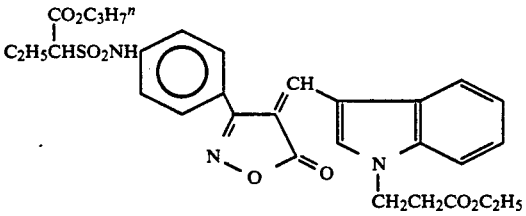
D-68
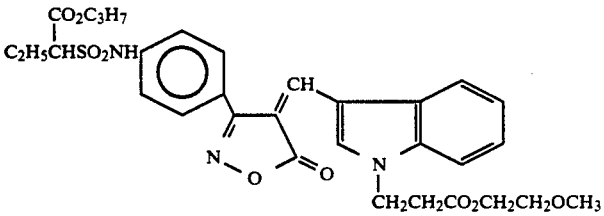

-continued
D-69
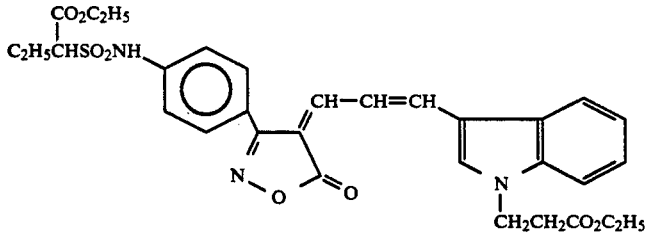
D-70
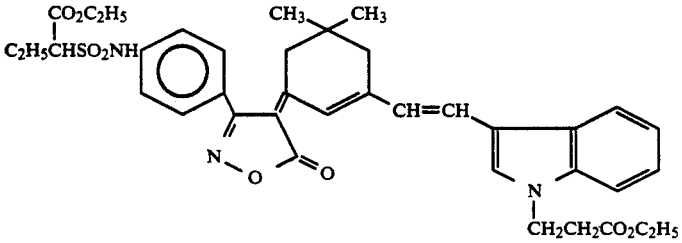
D-71
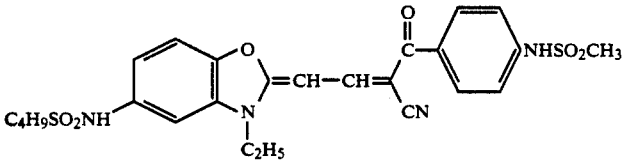
D-72
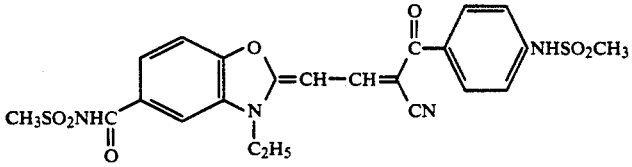
D-73
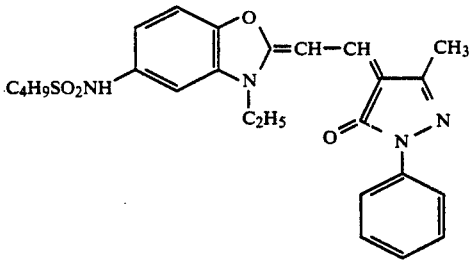
D-74
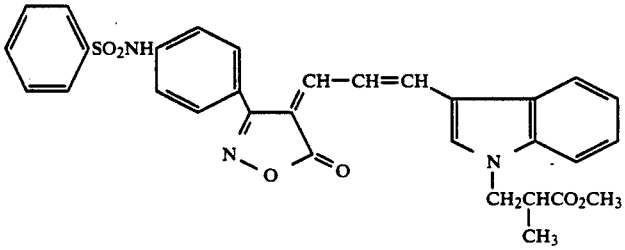

-continued

D-75

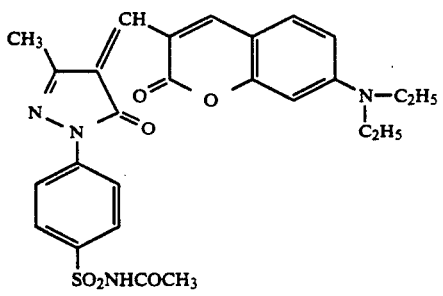

D-76

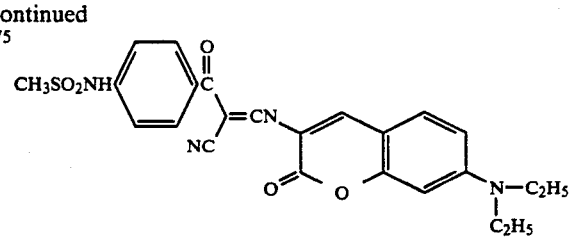

D-77

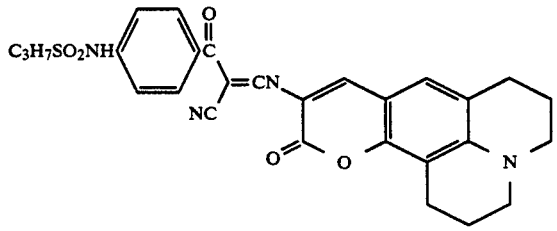

D-78

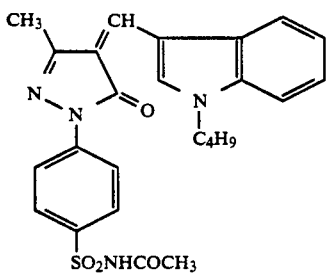

D-79

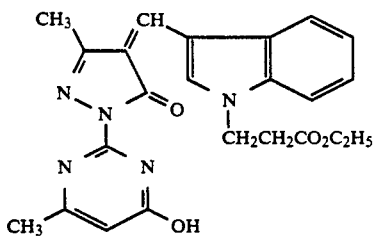

When the oil-soluble dyes are used as filter dyes or antihalation dyes, an effective amount thereof can be used. However, it is preferred that the dyes be used in such an amount as to give an optical density of 0.05 to 3.5. The dyes may be added at any stage before coating.

The amount of the dye to be used varies depending on the types of the polymers used in the dispersion of the dye and the dispersion methods, but is generally in the range of preferably $1\times10^{-3}$ to 3.0 g/m$^2$, particularly preferably $1\times10^{-3}$ to 1 g/m$^2$.

The dye dispersion can be added to any layer according to the particular purpose. For example, the dye dispersion can be added to any layer of an undercoat layer, an antihalation layer between a silver halide emulsion layer and the support, a silver halide emulsion layer, a color former layer, an interlayer, a protective layer and a back layer provided on the opposite side of the support to the silver halide emulsion layer. The dye dispersion can also be added to the hydrophilic colloid in an auxiliary layer.

The dye dispersion may be added to one layer or to two or more layers. Two or more dye dispersions independently or in the form of a mixture may be added to one layer or to two or more layers.

The dye dispersion of the present invention can be used in combination with other water soluble dyes, water-soluble dyes adsorbed by mordants, dispersions of fine solid dye particles or dye dispersions prepared by other methods different from the present invention.

The dyes of the present invention are used in the form of a dispersion in a water-insoluble, organic solvent-soluble polymer including at least one repeating unit of general formula (I). The dispersion can be prepared in the following manner.

The oil-soluble dye compound of the present invention is dissolved in a solution of the water-insoluble, organic solvent-soluble polymer dissolved in a co-solvent, and the resulting solution is dispersed in a hydrophilic colloid.

High-boiling organic solvents can be used together with the co-solvent to control the dispersibility of the oil-soluble dye compound of the present invention, spectral absorption characteristics or coatability.

The weight ratio of the high-boiling organic solvent to the polymer can be properly set according to purpose, but is preferably not higher than 2.0.

Examples of suitable high-boiling organic solvents are described in U.S. Pat. No. 2,322,027. Specific examples thereof include alkyl esters of phthalic acid (e.g., dibutyl phthalate, dioctyl phthalate), phosphoric esters (e.g., diphenyl phosphate, triphenyl phosphate, tricresyl phosphate, dioctyl butyl phosphate), citric esters (e.g., tributyl citrate), benzoic esters (e.g., octyl benzoate), alkylamides (e.g., diethyllaurylamide), fatty acid esters (e.g., dibutoxyethyl succinate, diethyl azelate), and trimesic esters (e.g., tributyl trimesate).

A typical hydrophilic colloid is gelatin. However, any hydrophilic colloid conventionally used in the field of photography can be used.

The dye dispersions of the present invention can be applied to all photographic materials such as black-and-white photographic materials (e.g., black-and-white films, X-ray films, films for plate making, black-and-white photographic paper, microfilms) and color photographic materials (e.g., color negative films, reversal color films, color positive films, color photographic paper, reversal color photographic paper).

In the photographic materials containing the silver halide emulsion layers of the present invention, light-sensitive materials conventionally used can be used, and silver halide emulsions conventionally used can be applied thereto. For example, the light-sensitive materials and silver halide emulsions described in JP-A-3-13936 and JP-A-3-13937 can be applied to the present invention. More specifically, the photographic silver halide emulsions, photographic materials containing the same, the supports, the processing methods and the exposure methods described in JP-A-3-13936 (line 8 of right lower column of page 8 to line 9 of left upper column of page 15) can be applied to the present invention.

Silver halides which can be preferably used in the silver halide emulsions of the present invention are silver bromide, silver iodobromide, silver iodochlorobromide, silver chlorobromide and silver chloride.

The light-sensitive material of the present invention may include a support having thereon at least one silver halide emulsion layer of a blue-sensitive layer, a green-sensitive layer and a red-sensitive layer. There is no particular limitation with regard to the number of silver halide emulsion layers and non-sensitive layers and the order thereof. A typical example is a silver halide photographic material comprising a support having thereon at least one light-sensitive layer consisting of a plurality of silver halide emulsion layers having substantially the same color sensitivity, but different light sensitivity, said light-sensitive layer being a unit light-sensitive layer having color sensitivity to any one of blue light, green light and red light. In a multi-layer silver halide color photographic material, the unit light-sensitive layers are generally arranged in order of the red-sensitive layer, the green-sensitive layer and the blue-sensitive layer from the side of the support. However, the arrangement may be made in the reverse order to that described above according to purpose. If desired, between light-sensitive layers having the same color sensitivity, there may be provided a light-sensitive layer having a different color sensitivity from that of the above layers.

Non-sensitive layers such as interlayers may be provided between the silver halide light-sensitive layers or as the uppermost layer or the lowermost layer.

The interlayers may contain couplers and DIR compounds as described in JP-A-61-43748, JP-A-59-113438, JP-A-59-113440, JP-A-61-20037 and JP-A-61-20038 and may contain color mixing inhibitors conventionally used.

It is preferred that each unit light-sensitive layer comprising a plurality of silver halide emulsion layers have a two-layer structure composed of a high-sensitivity emulsion layer and a low-sensitivity emulsion layer as described in West German Patent 1,121,470 or U.K. Patent 923,045. Usually, it is preferred that the layers be arranged so that light sensitivity is lowered toward the support. A non-sensitive layer may be provided between the silver halide emulsion layers. The low-sensitivity emulsion layer may be provided on the side which is farther away from the support, and the high-sensitivity layer may be provided on the side which is nearer the support as described in JP-A-57-112751, JP-A-62-200350, JP-A-62-200541 and JP-A-62-206543.

Specifically, the arrangement can be made in the order of low-sensitivity blue-sensitive layer (BL)/high-sensitivity blue-sensitive layer (BH)/high-sensitivity green-sensitive layer (GH)/low-sensitivity green-sensitive layer (GL)/high-sensitivity red-sensitive layer (RH)/low-sensitivity red-sensitive layer (RL), in the order of RH/BL/GL/GH/RH/RL or in the order of BH/BL/GH/GL/RL/RH from the side which is farthest away from the support.

The arrangement may be made in the order of blue-sensitive layer/GH/RH/GL/RL from the side which is farthest away from the support as described in JP-B-55-34932. The arrangement may be made in the order of blue-sensitive layer/GL/RL/GH/RH from the side which is farthest away from the support.

Further, there may be used a three-layer structure comprising three layers having different light sensitivity wherein light sensitivity is lowered toward the support in such an arrangement that the upper layer is a silver halide emulsion layer having the highest light sensitivity, the intermediate layer is a silver halide emulsion layer having lower light sensitivity than that of the upper layer, and the lower layer is a silver halide emulsion layer having lower light sensitivity than that of the intermediate layer, as described in JP B-49-15495. Even when the unit light-sensitive layer has a three-layer structure consisting of three layers having different light sensitivities, the arrangement of these layers having the same color sensitivity may be made in the order of intermediate-sensitivity emulsion layer/high-sensitivity emulsion layer/low-sensitivity emulsion layer from the side which is farther away from the support as described in JP-A-59-202464.

In another embodiment, the arrangement may be made in the order of high-sensitivity emulsion layer/low-sensitivity emulsion layer/intermediate-sensitivity emulsion layer or in the order of low-sensitivity emulsion layer/intermediate-sensitivity emulsion layer/high-sensitivity emulsion layer. Further, when the unit light-sensitive layer is constructed from a four-layer or greater than four-layer structure, various arrangements can be made as described above.

It is preferred that a donor layer (CL) having an interlayer effect having a different spectral sensitivity distribution from that of the main light-sensitive layer such as BL, GL or RL as described in U.S. Pat. Nos. 4,663,271, 4,705,744 and 4,707,436, JP-A-62-160448 and JP-A-63-89850 be provided adjacent to the main light-sensitive layer or in the vicinity of the main light-sensitive layer.

Various layer structures and arrangements can be chosen according to the purpose of the light-sensitive materials as mentioned above.

Silver halides which can be preferably used in the photographic emulsion layers of the photographic materials of the present invention include silver iodobromide, silver iodochloride and silver iodochlorobromide, each having a silver iodide content of not higher than about 30 mol %. A particularly preferred silver halide is silver iodobromide or silver iodochlorobromide having a silver iodide content of about 2 to about 10 mol %.

The silver halide grains to be contained in the photographic emulsions may have a regular crystal form such as cubic, octahedral or tetradecahedral, an irregular crystal form such as spherical or plate-like, a crystal form having a defect such as a twinning plane, or a composite form of these crystal forms.

With regard to the grain size of the silver halide grains, the grains may range from fine grains having a grain size of not larger than about 0.2 μm (where the diameter of the grain is defined as the diameter of a circle having an area equal to the projected area of the grain) to large-size grains having a grain size of about 10 μm. Any of polydisperse emulsions and monodisperse emulsions can be used.

The silver halide photographic emulsions of the present invention can be prepared by using the methods described in *Research Disclosure* (RD) No. 17643 (December 1978), pages 22 to 23, "I. Emulsion preparation and types"; *Research Disclosure* No. 18716 (November 1979), page 648; *Research Disclosure* No. 307105 (November 1989), pages 863 to 865; P. Glafkides, *Chemie et Phisique Photographique* (Paul Montel 1967); G. F. Duffin, *Photographic Emulsion Chemistry* (Focal Press 1966); and V. L. Zelikman et al., *Making and Coating Photographic Emulsions* (Focal Press 1964).

Monodisperse emulsions as described in U.S. Pat. Nos. 3,574,628 and 3,655,394 are also preferred.

Tabular grains having an aspect ratio of not lower than about 3 can be used in the present invention. The tabular grains can be easily prepared by using the methods described in Gutoff, *Photographic Science and Engineering, Vol.* 14, pp. 248–257 (1970), U.S. Pat. Nos. 4,434,226, 4,414,310, 4,433,048 and 4,439,520 and U.K. Patent 2,112,157.

The crystal structure of the grain may be uniform, or the interior of the grain and the surface layer thereof may be different from each other in halogen composition. The crystal structure may be in the form of a laminar structure. Silver halides having different halogen compositions may be joined to each other by epitaxial growth. A silver halide may be joined to a compound other than silver halide, such as silver rhodanide or lead oxide. A mixture of grains having various crystal forms may be used.

Any of a surface latent image type emulsion wherein a latent image is predominantly formed on the surface of the grain and an internal latent image type emulsion wherein a latent image is predominantly formed in the interior of the grain may be used. However, the emulsion must be a negative type emulsion. A core/shell type internal latent image type emulsion as described in JP-A-63-264740 may be used as the internal latent image type emulsion. The preparation of the core/shell type internal latent image type emulsion is described in JP-A-59-133542. The thickness of the shell varies depending on the processing method, but is preferably 3 to 40 nm, particularly preferably 5 to 20 nm.

The silver halide emulsions are usually subjected to physical ripening, chemical ripening and spectral sensitization. Additives used in these stages are described in *Research Disclosure* Nos. 17643, 18716 and 307105 and listed hereinafter.

In the light-sensitive materials of the present invention, a mixture of two or more emulsions having different characteristics from each other in at least one of particle size, particle size distribution, halogen composition, crystal form and sensitivity can be used in the same layer.

Silver halide grains wherein the surfaces of the grains are fogged as described in U.S. Pat. No. 4,082,553, silver halide grains wherein the interiors of the grains are fogged as described in JP-A-59-214852 and colloidal silver can be preferably used in the light-sensitive emulsion layers and/or in substantially non-sensitive hydrophilic colloid layers. The term "silver halide grains wherein the interiors or surfaces of the grains are fogged" as used herein refers to silver halide grains which can be developed uniformly (non-imagewise) irrespectively of the unexposed areas and exposed areas of the light-sensitive material. The preparation of the silver halide grains wherein the interiors or surfaces of the grains are fogged is described in U.S. Pat. No. 4,626,498 and JP-A-59-214852.

The silver halides which form the internal nucleus of the core/shell type silver halide grains wherein the interiors of the grains are fogged may have the same halogen composition or different halogen compositions. As the silver halide where the interiors or surfaces of the grains are fogged, there can be used any of silver chloride, silver chlorobromide, silver iodobromide and silver chloroiodobromide. There is no particular limitation with regard to the grain size of these fogged silver halide grains, but the grains have a mean grain size of preferably 0.01 to 0.75 μm, particularly preferably 0.05 to 0.6 μm. There is also no particular limitation with regard to crystal form. For example, the grains may have a regular form. Polydisperse emulsions can be used. However, monodisperse emulsions in which at least 95% (in terms of the weight of the silver halide grains or in terms of the number of grains) of the grains comprise grains having a grain size of within ±40% of the mean grain size are preferable.

It is preferred that non-sensitive fine silver halide grains be used in the present invention. The expression "non-sensitive fine silver halide grains" as used herein refers to fine silver halide grains which are not sensitive to light during imagewise exposure for obtaining a dye image and which are not substantially developed in the development stage. It is preferred that these grains not be previously fogged.

The fine silver halide grains have a silver bromide content of 0 to 100 mol % and may optionally contain silver chloride and/or silver iodide. Grains containing 0.5 to 10 mol % of silver iodide are preferred.

The fine silver halide grains have a mean grain size (in terms of the average of the diameters of circles having areas equal to the projected areas of the grains) of preferably 0.01 to 0.5 μm, more preferably 0.02 to 0.2 μm.

Fine silver halide grains can be prepared in the same manner as in the preparation of general light-sensitive silver halide grains. It is not required that the surfaces of the silver halide grains be optically sensitized or spectral-sensitized. It is preferred that a conventional stabilizer such as a triazole, an azaindene, a benzthiazolium or a mercapto compound or a zinc compound be previously added to fine silver halide grains before adding the coating solution. Colloidal silver can be incorporated in a layer containing the fine silver halide grains.

The coating weight of the light-sensitive material of the present invention is preferably not more than 6.0 $g/m^2$, most preferably not more than 4.5 $g/m^2$ in terms of silver.

Conventional photographic additives which can be used in the present invention are described in the aforesaid three *Research Disclosures* (RD) and listed below.

| Additive | RD17643 | RD18716 | RD307105 |
|---|---|---|---|
| 1. Chemical sensitizing agent | page 23 | right column of page 648 | page 866 |
| 2. Sensitivity increaser | | right column of page 648 | |
| 3. Spectral sensitizing agent, supersensitizing agent | pages 23–24 | right column of page 648 to right column of page 649 | pages 866–868 |
| 4. Brightening agent | page 24 | right column of page 647 | page 868 |
| 5. Anti-fogging agent, | pages 24–25 | right column | pages 868– |

-continued

| Additive | RD17643 | RD18716 | RD307105 |
|---|---|---|---|
| stabilizer | | of page 649 | 870 |
| 6. Light absorber, filter dye, ultraviolet light absorber | pages 25–26 | right column of page 649 to left column of page 650 | page 873 |
| 7. Anti-staining agent | right column of page 25 | left column to right column of page 650 | page 872 |
| 8. Dye image stabilizer | page 25 | left column of page 650 | page 872 |
| 9. Hardening agent | page 26 | left column of page 651 | pages 874–875 |
| 10. Binder | page 26 | left column of page 651 | pages 873–874 |
| 11. Plasticizer, lubricant | page 27 | right column of page 650 | page 876 |
| 12. Coating aid, surfactant | pages 26–27 | right column of page 650 | pages 875–876 |
| 13. Antistatic agent | page 27 | right column of page 650 | pages 876–877 |
| 14. Matting agent | | | pages 878–879 |

It is preferred that compounds capable of reacting with formaldehyde to fix it as described in U.S. Pat. Nos. 4,411,987 and 4,435,503 be added to the light-sensitive materials to prevent photographic performance from being deteriorated by formaldehyde gas.

It is also preferred that mercapto compounds as described in U.S. Pat. Nos. 4,740,454 and 4,788,132, JP-A-62-18539 and JP-A-1-283551 be incorporated in the light-sensitive materials of the present invention.

Further, it is preferred that compounds which release a fogging agent, a development accelerator, a solvent for silver halide or their precursors irrespective of the amount of developed silver formed by development as described in JP-A-1-106052 be incorporated in the light-sensitive materials of the present invention.

Various color couplers can be used in the present invention. Examples thereof are described in patent specifications cited in the aforesaid *Research Disclosure* No. 17643, VII-C to G and *Research Disclosure* No. 307105, VII-C to G.

Examples of yellow couplers which can be preferably used include those described in U.S. Pat. Nos. 3,933,501 4,022,620, 4,326,024, 4,401,752 and 4,248,961, JP-B-58-10739, U.K. Patents 1,425,020 and 1,476,760, U.S. Pat. Nos. 3,973,968, 4,314,023 and 4,511,649 and European Patent 249,473A.

Preferred magenta couplers are 5-pyrazolone and pyrazoloazole compounds. Magenta couplers which can be particularly preferably used include those described in U.S. Pat. Nos. 4,310,619 and 4,351,897, European Patent 73,639, U.S. Pat. Nos. 3,061,432 and 3,725,067, *Research Disclosure* No. 24220 (June 1984), JP-A-60-33552, *Research Disclosure* No. 24230 (June 1984), JP-A-60-43659, JP-A-61-72238, JP-A-60-35730, JP-A-55-118034, JP-A-60-185951, U.S. Pat. Nos. 4,500,630, 4,540,654 and 4,556,630 and WO(PCT) 88/04795.

Cyan couplers include phenol couplers and naphthol couplers. Cyan couplers which can be preferably used include those described in U.S. Pat. Nos. 4,052,212, 4,146,396, 4,228,233, 4,296,200, 2,369,929, 2,801,174, 2,772,162, 2,895,826, 3,772,002, 3,758,308, 4,334,011 and 4,327,173, West German Patent Laid-Open No. 3,329,729, European Patents 121,365A and 249,453A, U.S. Pat. Nos. 3,446,622, 4,333,999, 4,775,616, 4,451,559, 4,427,767, 4,690,889, 4,254,212 and 4,296,199 and JP-A-61-42658. Further, pyrazoloazole couplers described in JP-A-64-553, JP-A-64-554, JP-A-64-555 and JP-A-64-556 and imidazole couplers described in U.S. Pat. No. 4,818,672 can be used.

Typical examples of color forming polymer couplers are described in U.S. Pat. Nos. 3,451,820, 4,080,211, 4,367,282, 4,409,320 and 4,576,910, U.K. Patent 2,102,137 and European Patent 341,188A.

Preferred examples of couplers whose developed dye has proper diffusibility include those described in U.S. Pat. No. 4,366,237, U.K. Patent 2,125,570, European Patent 96,570 and West German Patent Laid-Open No. 3,234,533.

Preferred examples of colored couplers for correcting undesired absorptions of developed dyes include those described in *Research Disclosure* No. 17643, item VII-G, ibid., No. 307105, item VII-G, U.S. Pat. No. 4,163,670, JP-B-57-39413, U.S. Pat. Nos. 4,004,929 and 4,138,258 and U.K. Patent 1,146,368. Further, there can be used couplers for correcting undesired absorptions of developed dyes by releasing a fluorescent dye during coupling as described in U.S. Pat. No. 4,774,181 and couplers having, as an eliminable group, a dye precursor group capable of reacting with a developing agent to form a dye as described in U.S. Pat. No. 4,777,120.

Compounds which release photographically useful groups by coupling can be preferably used in the present invention. Preferred examples of DIR couplers which release a restrainer include those described in patent specifications cited in the aforesaid RD No. 17643, item VII-F and RD No. 307105, item VII-F, JP-A-57-151944, JP- A-57-154234, JP-A-60-184248, JP-A-63-37346, JP-A-63-37350, and U.S. Pat. Nos. 4,248,962 and 4,782,012.

Couplers which release a bleaching accelerator as described in RD No. 11449, RD No. 24241 and JP-A-61-201247 are effective in shortening the processing time of processing stages having a bleaching ability. Particularly when the couplers are added to light-sensitive materials containing tabular silver halide grains, the effect is remarkable. Preferred examples of couplers which imagewise release a nucleating agent or a development accelerator during development include those described in U.K. Patents 2,097,140 and 2,131,188, JP-A-59-157638 and JP-A-59-170840. Further, compounds which release a fogging agent, a development accelerator, a solvent for silver halide, etc. by an oxidation-reduction reaction thereof with an oxidation product of a developing agent as described in JP-A-60-107029, JP-A-60-252340, JP-A-1-44940 and JP-A-1-45687 can be preferably used.

Examples of compounds which can be used in the light-sensitive materials of the present invention include competitive couplers as described in U.S. Pat. No. 4,130,427; polyequivalent type couplers as described in U.S. Pat. Nos. 4,283,472, 4,338,393 and 4,310,618; DIR redox compound releasing couplers, DIR coupler releasing couplers, DIR coupler releasing redox compounds or DIR redox releasing compounds as described in JP-A-60-185950 and JP-A-62-24252; couplers which release a dye whose color is restored to its original color after elimination as described in European Patents 173,302A and 313,308A; couplers which release a ligand as described in U.S. Pat. No. 4,555,477; couplers which release a leuco dye as described in JP-A-63-75747; and couplers which release a fluorescent dye as described in U.S. Pat. No. 4,774,181.

These couplers which may be used in the present invention can be introduced into the light-sensitive materials by various conventional dispersion methods.

Examples of high-boiling solvents which can be used in oil-in-water dispersion methods are described in U.S. Pat. No. 2,322,027. Specific examples of high-boiling organic solvents having a boiling point of not lower than 175° C. under atmospheric pressure which can be used in the oil-in-water dispersion methods include phthalic esters (e.g., dibutyl phthalate, dicyclohexyl phthalate, di-2-ethylhexyl phthalate, decyl phthalate, bis(2,4-di-t-amylphenyl)-phthalate, bis(2,4-di-t-amylphenyl)isophthalate, bis(1,1-diethylpropyl)phthalate), phosphoric or phosphonic esters (e.g., triphenyl phosphate, tricresyl phosphate, 2-ethylhexyl diphenyl phosphate, tricyclohexyl phosphate, tri-2-ethylhexyl phosphate, tridodecyl phosphate, tributoxyethyl phosphate, trichloropropyl phosphate, di-2-ethylhexyl phenyl phosphate), benzoic esters (e.g., 2-ethylhexyl benzoate, dodecyl benzoate, 2-ethylhexyl p-hydroxybenzoate), amides (e.g., N,N-diethyldodecaneamide, N,N-diethyllaurylamide, N-tetradecylpyrrolidone), alcohols or phenols (e.g., isostearyl alcohol, 2,4-di-tert-amylphenol), aliphatic carboxylic acid esters (e.g., bis(2-ethylhexyl)-sebacate, dioctyl azelate, glycerol tributyrate, isostearyl lactate, trioctyl citrate), aniline derivatives (e.g., N,N-dibutyl-2-butoxy-5-tert-octylaniline), and hydrocarbons (e.g., paraffin, dodecylbenzene, diisobutylnaphthalene). Organic solvents having a boiling point of not lower than about 30° C., preferably not lower than about 50° C., but not higher than about 160° C. can be used as co-solvents. Typical examples of such co-solvents include ethyl acetate, butyl acetate, ethyl propionate, methyl ethyl ketone, cyclohexanone, 2-ethoxyethyl acetate and dimethylformamide.

Examples of the stages and effects of latex dispersion methods and examples of impregnating latex are described in U.S. Pat. No. 4,199,363 and West German Patent Application (OLS) Nos. 2,541,274 and 2,541,230.

It is preferred that phenethyl alcohol or various antiseptic agents or antifungal agents such as 1,2-benzisothiazoline-3-one, n-butyl p-hydroxybenzoate, phenol, 4-chloro-3,5-dimethylphenol, 2-phenoxyethanol or 2-(4-thiazoyl)benzimidazole be added to color photographic materials.

Examples of supports which can be used in the present invention are described in the aforesaid RD No. 17642 (page 28), RD No. 18716 (right column of page 647 to left column of page 648) and RD No. 307105 (page 879).

The sum total of the thicknesses of all the hydrophilic colloid layers on the emulsion layer side of a color photographic material of the present invention is preferably not more than 28 μm, more preferably not more than 23 μm, still more preferably not more than 18 μm, and particularly preferably not more than 16 μm. The layer swelling rate $T_{\frac{1}{2}}$ of the photographic material is preferably not greater than 30 seconds, more preferably not greater than 20 seconds. The layer thickness refers to the layer thickness obtained by making a measurement under moisture conditioning at 25° C. and 55% RH for 2 days. The layer swelling rate $T_{\frac{1}{2}}$ can be measured by a conventional method, for example, by using a swellometer of the type described in A. Green, *Photographic Science and Engineering*, Vol. 19, No. 2, pp. 124–129. The layer swelling rate $T_{\frac{1}{2}}$ is defined as the time taken until the layer thickness reaches ½ of the saturated layer thickness when 90% of the maximum swollen layer thickness obtained by processing the photographic material in a color developing solution at 30° C. for 3¼ minutes is defined as the saturated layer thickness.

The layer swelling rate $T_{\frac{1}{2}}$ can be controlled by adding a hardening agent to gelatin as a binder or by changing conditions (e.g., temperature, humidity, etc.) with time after coating. The swelling ratio is preferably 150 to 400%. The swelling ratio can be calculated from the maximum swollen layer thickness under the above-described conditions by using the following formula.

$$\text{Swelling ratio (\%)} = \frac{\text{Maximum swollen layer thickness} - \text{layer thickness}}{\text{Layer thickness}}$$

It is preferred that the photographic materials of the present invention be provided with a hydrophilic colloid layer (called a back layer) having a total dry thickness of 2 to 2 μm on the side of the support opposite to the emulsion layer side. It is preferred that the back layer contain the above-described light absorber, filter dye, ultraviolet light absorber, antistatic agent, hardening agent, binder, plasticizer, lubricant, coating aid, surfactant, etc. The swelling ratio of the back layer is preferably 150 to 500%.

A color photographic material of the present invention can be processed by conventional methods as described in the aforesaid RD No. 17643 (pages 28 to 29), RD No. 18716 (left column to right column of page 651) and RD No. 307105 (pages 880 to 881)

Color developing solutions which may be used in the development of the photographic materials of the present invention are preferably aqueous alkaline solutions containing aromatic primary amine color developing agents as principal components. Aminophenol compounds are useful as color developing agents and p-phenylenediamine compounds are preferred as color developing agents. Typical examples thereof include 3-methyl-4-amino-N,N-diethylaniline, 3-methyl-4-amino-N-ethyl-N-β-hydroxyethylaniline, 3-methyl-4-amino-N-ethyl-N-β-methanesulfonamidoethylaniline, 3-methyl-4-amino-N-ethyl-N-β-methoxyethylaniline and salts thereof such as sulfates, hydrochlorides and p-toluenesulfonates. Among them, 3-methyl-4-amino-N-ethyl-N-β-hydroxyethylaniline sulfate is particularly preferred. These compounds may be used either alone or in combinations of two or more of them.

Generally, the color developing solutions contain pH buffering agents such as alkali metal carbonates, borates and phosphates, restrainers such as chlorides, bromides, iodides, benzimidazoles, benzothiazoles and mercapto compounds and anti-fogging agents. If desired, the color developing solutions may optionally contain preservatives such as hydroxylamine, diethylhydroxylamine, sulfites, hydrazines such as N,N-biscarboxymethylhydrazine, phenylsemicarbazides, triethanolamine and catecholsulfonic acids; organic solvents such as ethylene glycol and diethylene glycol; development accelerators such as benzyl alcohol, polyethylene glycol, quaternary ammonium salts and amines; color forming couplers; competitive couplers; auxiliary developing agents such as 1-phenyl-3-pyrazolidone; tackifiers; and chelating agents such as aminopolycarboxylic acids, aminopolyphosphonic acids, alkylphosphonic acids and phosphonocarboxylic acids, for example, ethylenediaminetetraacetic acid, nitrilotriacetic acid, diethylenetriaminepentaacetic acid, cylclohexanediaminetetraacetic acid, hydroxyethylimidinoacetic acid, 1-hydroxyethylidene-1,1-diphosphonic acid, nitrilo-N,N,N-trimethylenephosphonic acid, ethylenediamine-N,N,N',N'-tetramethylenephosphonic acid and ethylenediamine-di(o-hydroxyphenylacetic acid) and salts thereof.

Generally, when reversal processing is to be conducted, black-and-white development is first carried out and color development is then carried out. Black-and-white developing solutions may contain conventional developing agents such as dihydroxybenzenes (e.g., hydroquinone), 3-pyrazolidones (e.g., 1-phenyl-3-pyrazolidone) and aminophenols (e.g., N-methyl-p-aminophenol). These developing agents may be used either alone or in combinations of two or more of them.

The pH of the color developing solutions and the black-and-white developing solutions is generally in the range of 9 to 12. The replenishment rate of these developing solutions varies depending on the type of the color photographic material, but is usually not more than 3 l per $m^2$ of the photographic material. The replenishment rate can be reduced to 500 ml or less when the concentration of bromide ion in the replenisher is reduced. When the replenishment is to be reduced, it is desirable that the contact area of the processing solution with air be reduced to prevent the solution from being evaporated or oxidized by air.

The contact area of the photographic processing solution in the processing tank with air can be represented by the following opening ratio.

$$\text{Opening ratio} = [\text{contact area } (cm^2) \text{ of processing solution with air}] \div [\text{volume } (cm^3) \text{ of processing solution}]$$

The opening ratio is preferably not more than 0.1, more preferably 0.001 to 0.05. Examples of methods for reducing the opening ratio include a method wherein a cover such as a floating cover is provided on the surface of the photographic processing solution in the processing tank; a method using a movable cover as described in JP-A-1-82033; and a slit processing method as described in JP-A-63-216050. It is preferred that the reduction of the opening ratio be applied to not only both the color development stage and the black-and-white development stage but also to all subsequent stages such as bleaching, bleaching-fixing, fixing, rinsing and stabilization stages. The replenishment rate can be reduced by using a means for inhibiting the accumulation of bromide ion in the developing solution.

The color development time is usually set to 2 to 5 minutes. However, when the color developing agents are used at a higher concentration under high temperature and high pH conditions, the processing time can be shortened.

After color development, the photographic emulsion layer is generally bleached. Bleaching may be carried out simultaneously with fixing (bleaching-fixing treatment), or bleaching and fixing may be carried out separately. After bleaching, a bleaching-fixing treatment may be conducted to expedite processing. Bleaching-fixing may be conducted by using a bleaching-fixing bath composed of two consecutive baths. Fixing may be conducted before the bleaching-fixing treatment. After the bleaching-fixing treatment, bleaching may be conducted according to purpose. Examples of bleaching agents include compounds of polyvalent metals such as iron(III), peracids, quinones and nitro compounds. Typical examples of bleaching agents include organic complex salts of iron(III) such as complex salts of aminopolycarboxylic acids (e.g., ethylenediaminetetraacetic acid, diethylenetriaminepentaacetic acid cyclohexanediaminetetraacetic acid, methyliminodiacetic acid, 1,3-diaminopropanetetraacetic acid, glycol ether diaminetetraacetic acid, etc.) citric acid, tartaric acid, malic acid, etc. Among them, iron(III) complex salts of aminopolycarboxylic acids such as (ethylenediaminetetraacetate)-iron(III) complex and 1,3-diaminopropanetetraacetato iron(III) complex salt are preferred from the viewpoints of rapid processing and prevention of environmental pollution. Further, iron(III) complex salts of aminopolycarboxylic acids are useful for bleaching solutions and bleaching-fixing solutions. The pH of the bleaching solutions containing the iron(III) complex salts of the aminopolycarboxylic acids and the bleaching-fixing solutions containing said iron(III) complex salts is generally in the range of 4.0 to 8. Lower pH may be used to expedite processing.

If desired, the bleaching solution, the bleaching-fixing solution and the previous bath thereto may contain bleaching accelerators. Examples of bleaching accelerators include compounds having a mercapto group or a disulfide group as described in U.S. Pat. No. 3,893,858, West German Patents 1,290,812 and 2,059,988, JP-A-53-32736, JP-A-53-57831, JP-A-53-37418, JP-A-53-72623, JP-A-53-95630, JP-A-53-95631, JP-A-53-104232, JP-A-53-124424, JP-A-53-141623, JP-A-53-28426 and *Research Disclosure* No. 17129 (July 1978); thiazolidine derivatives as described in JP-A-50-140129: thiourea derivatives as described in JP-B-45-8506, JP-A-52-20832, JP-A-53-32735 and U.S. Pat. No. 3,706,561; iodides as described in West German Patent 1,127,715 and JP-A-58-16235; polyoxyethylene compounds as described in West German Patents 996,410 and 2,748,430; polyamine compounds as described in JP-B-45-8836; compounds as described in JP-A-49-42434, JP-A-49-59644, JP-A-53-94927, JP-A-54-35727, JP-A-55-26506 and JP-A-58-163940; and bromide ions. Among them, the compounds having a mercapto group or a disulfide group are preferred from the viewpoint of high accelerating effect. Particularly, the compounds described in U.S. Pat. No. 3,893,858, West German Patent 1,290,812 and JP-A-53-95630 are preferred. Further, the compounds described in U.S. Pat. No. 4,552,834 are preferred. These bleaching accelerators may be incorporated in the photographic materials. These bleaching accelerators are particularly effective in conducting bleaching-fixing of color photographic materials for photographing.

It is preferred that the bleaching solution and the bleaching-fixing solution contain organic acids in addition to the above-described compounds to prevent bleach stain from being caused. Particularly preferred organic acids are compounds having an acid dissociation constant (pKa) of 2 to 5 such as acetic acid, propionic acid and hydroxyacetic acid.

Examples of fixing agents which can be used in the fixing solution and bleaching-fixing solution include thiosulfates, thiocyanates, thioether compounds, thioureas and various iodides. The thiosulfates are generally used. Particularly, ammonium thiosulfate is most widely used. Further, it is preferred that combinations of thiosulfates with thiocyanates, thioether compounds or thioureas be used. Sulfites, bisulfites, carbonyl bisulfite adducts or sulfinic acid compounds as described in European Patent 294,769A are preferred as preservatives for the fixing solution or the bleaching-fixing solution. Further, it is preferred that aminopolycarboxylic acids or organic phosphonic acids be added to the fixing solution and the bleaching-fixing solution to stabilize these solutions.

It is also preferred that compounds having a pKa of 6.0 to 9.0, preferably imidazoles such as imidazole, 1-methylimidazole, 1-ethylimidazole and 2-methylimidazole in an amount of 0.1 to 10 mol/l be added to the fixing solution or the bleaching-fixing solution of the present invention to adjust pH.

It is preferred that the total time of the desilverization stage be as short as possible, so long as a failure of desilverization is not caused. The desilverization time is preferably 1 to 3 minutes, more preferably 1 to 2 minutes. The processing temperature is 25° to 50° C., preferably 35° to 45° C. When processing is carried out in the preferred temperature range, the desilverization rate is improved and stain can be effectively prevented from being formed after processing.

It is preferred that stirring be intensified as much as possible in the desilverization stage. Examples of methods for intensifying stirring include a method wherein a jet stream of the processing solution is allowed to collide with the emulsion layer surface of the light-sensitive material as described in JP-A-62-183460; a method wherein the stirring effect is increased by using a rotating means as described in JP-A-62-183461; a method wherein while a wiper blade provided in the solution is brought into contact with the emulsion layer surface, the light-sensitive material is moved to form a turbulent flow on the surface of the emulsion layer to thereby increase the stirring effect; and a method wherein the circulating flow rate of the the processing solution as a whole is increased. These means for improving the stirring effect are effective in stirring any of the bleaching solution, the bleaching-fixing solution and the fixing solution. It is believed that the feed of the bleaching agent and the fixing agent into the emulsion layers can be expedited by improving the stirring effect and as a result, the desilverization rate can be increased. The aforesaid means for improving stirring are more effective when bleaching accelerators are used. The accelerating effect can be remarkably increased and the problem of a fixing inhibiting action caused by the bleaching accelerators can be solved.

It is preferred that automatic processors for use in processing the light-sensitive materials of the present invention be provided with a light-sensitive material conveying means as described in JP-A-60-191257, JP-A-60-191258 and JP-A-60-191259. The amount of the processing solution brought over from the prebath to the subsequent bath can be greatly reduced by such a conveying means, and the effect of preventing the performance of the processing solution from being deteriorated is high as described in the aforesaid JP-A-60-191257. Such an effect is particularly effective in shortening the processing time in each stage and in reducing the replenishment rate of the processing solution.

Usually, the silver halide color photographic materials of the present invention are subjected to a washing and/or stabilization stage after desilverization. The amount of rinsing water in the washing stage varies widely depending on the characteristics (e.g., depending on materials used such as couplers) of the photographic materials, use, the temperature of rinsing water, the number of rinsing tanks (the number of stages), the replenishing system (countercurrent, direct flow) and other conditions. The relationship between the amount of water and the number of rinsing ranks in a multi-stage countercurrent system can be determined by the method described in *Journal of the Society of Motion Picture and Television Engineers*, Vol. 64, pp. 248-253 (May 1955). According to the multi-stage countercurrent system described in the above literature, the amount of rinsing water can be greatly reduced. However, there is caused a problem that the residence time of water in the tanks is prolonged and as a result, bacteria are grown and the resulting suspended matter is deposited on the photographic material. A method for reducing calcium ions and magnesium ions as described in JP-A-62-288838 can be effectively used in the processing of color photographic materials of the present invention to solve the above-mentioned problem. Further, isothiazolone compounds, thiabenzazole compounds, chlorine-containing germicides such as sodium chlorinated isocyanurate and benztriazole as described in JP-A-57-8542 and germicides as described in *Chemistry of Germicidal Antifungal Agent*, written by Hiroshi Horiguchi (1986), *Sterilization, Disinfection, Antifungal Technique*, edited by Sanitary Technique Society (1982) and *Antibacterial and Antifungal Encyclopedia*, edited by Nippon Antibacterial Antifungal Society (1986), can be used.

The pH of rinsing water in the treatment of the photographic materials of the present invention is in the range of 4 to 9, preferably 5 to 8. The temperature of the rinsing water and the washing time vary depending on the characteristics of the photographic materials, use, etc., but the temperature and time of washing are generally 15° to 45° C. for 20 seconds to 10 minutes, preferably 25° to 40° C. for 30 seconds to 5 minutes. The photographic materials of the present invention may be processed directly with stabilizing solutions in place of said rinsing water. Such stabilizing treatment can be carried out by conventional methods as described in JP-A-57-8543, JP-A-58-14834 and JP A-60-220345.

A stabilizing treatment subsequent to the rinsing may be conducted. The stabilizing treatment may be used as the final bath for a color photographic material for photographing. An example thereof is a stabilizing bath containing a dye stabilizer and a surfactant. Examples of dye stabilizers include aldehydes such as formalin and glutaraldehyde, N-methylol compounds, hexamethylenetetramine and aldehyde sulfite adducts. The stabilizing bath may contain various chelating agents and antifungal agents.

The overflow solution from the replenishment of rinsing water and/or stabilizing can be reused in other stages such as the desilverization stage.

It is preferred that when each processing solution is concentrated by evaporation in processing using automatic processors, the concentration of each processing solution be corrected by adding water thereto.

Color developing agents may be incorporated in silver halide color photographic materials of the present invention for the purpose of simplifying and expediting processing. It is preferred that precursors of the color developing agents be used for the incorporation thereof in the photographic materials. Examples of such precursors include indoaniline compounds as described in U.S. Pat. No. 3,342,597; Schiff base silver compounds as described in U.S. Pat. No. 3,342,599, *Research Disclo-*

*sure* No. 14850 and ibid., No. 15159; aldol compounds as described in *Research Disclosure* No. 13924; metal complex salts as described in U.S. Pat. No. 3,719,492; and urethane compounds as described in JP-A-53-135628.

If desired, 1-phenyl-3-pyrazolidones may be incorporated in silver halide color photographic materials of the present invention for the purpose of accelerating color development. Typical examples of such compounds include those described in JP-A-56-64339, JP-A-57-144547 and JP-A-58-115438.

In the present invention, various processing solutions are used at a temperature of 10° to 50° C. Generally, a temperature of 33° to 38° C. is used. However, higher temperatures may be used to accelerate processing and to shorten processing time, while lower temperatures may be used to improve image quality and to improve the stability of the processing solutions.

The silver halide light-sensitive materials of the present invention can be applied to heat developing light-sensitive materials as described in U.S. Pat. No. 4,500,626, JP-A-60-133449, JP-A-59-218443, JP-A-61-238056 and European Patent 210,660A2.

The present invention will now be illustrated in greater detail by reference to the following examples which, however, are not to be construed as limiting the present invention in any way.

EXAMPLE 1

Preparation of Samples 101 to 107

The following layers having the following compositions were coated on an undercoated cellulose triacetate film support to prepare Samples 101 to 107.

The numeral to the right of each ingredient represents the coating weight in units of g/m$^2$.

| | |
|---|---|
| First layer | |
| Dye | indicated in Table 1 |
| High-boiling organic solvent or polymer | indicated in Table 1 |
| Gelatin | 3.50 g/m$^2$ |
| Second layer | |
| H-1 | 0.12 g/m$^2$ |
| B-1 (diameter: 1.7 μm) | 0.05 g/m$^2$ |
| B-2 (diameter: 1.7 μm) | 0.10 g/m$^2$ |
| Gelatin | 2.00 g/m$^2$ |

The dye in the first layer was coated as a dye dispersion prepared in the following manner.

$2\times10^{-3}$ mol of the dye and 2 g of a high-boiling organic solvent or a polymer were dissolved in 20 ml of ethyl acetate. The resulting solution was mixed with 50 ml of a 10% gelatin solution containing 0.2 g of sodium dodecylbenzenesulfonate, and the mixture was emulsified and dispersed by using a high-speed homogenizer.

TABLE 1

| | Dye | Dispersion medium | Absorbance | Half width/ absorbance | Residual color ratio after processing with processing solution A (%) | Adhesion |
|---|---|---|---|---|---|---|
| Sample 101 (Comp. Ex.) | D-27 (0.20 g/m$^2$) | HBS-1 (0.40 g/m$^2$) | 0.88 | 110 | 7 | X |
| Sample 102 (Comp. Ex.) | D-27 (0.20 g/m$^2$) | HBS-2 (0.40 g/m$^2$) | 0.78 | 120 | 6 | X |
| Sample 103 (Comp. Ex.) | D-27 (0.20 g/m$^2$) | Polymer A (0.40 g/m$^2$) | 0.35 | 200 | 10 | ○ |
| Sample 104 (Comp. Ex.) | D-27 (0.20 g/m$^2$) | Polymer B (0.40 g/m$^2$) | 0.31 | 180 | 12 | ○ |
| Sample 105 (Invention) | D-27 (0.20 g/m$^2$) | P-1 (0.40 g/m$^2$) | 0.92 | 110 | 6 | ○ |
| Sample 106 (Invention) | D-27 (0.20 g/m$^2$) | P-2 (0.40 g/m$^2$) | 0.95 | 110 | 5 | ○ |
| Sample 107 (Invention) | D-27 (0.20 g/m$^2$) | P-17 (0.40 g/m$^2$) | 0.89 | 110 | 4 | ○ |

H-1

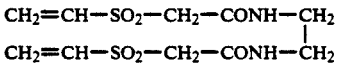

B-1

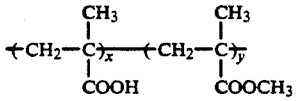

x/y = 10/90 by moles

B-2

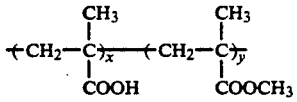

x/y = 40/60 by moles

HBS-1
Tricresyl phosphate
HBS-2
Di-n-butyl phthalate
Polymer A

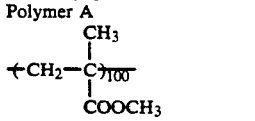

TABLE 1-continued

Polymer B

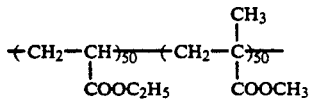

The hue of these dyes was evaluated by determining the absorbance of absorption spectrum and the half width (width of ½ of peak of $\lambda_{max}$) ÷ absorbance. Decolorizability (the ratio of the density of the residual color after processing to the density of the dye before processing) was evaluated by measuring the absorption of unprocessed samples and processed samples obtained by immersing each sample in a processing solution A for 30 seconds and then drying the sample.

Processing Solution A

To 3 g of sodium sulfite, 1 l of water was added. Then, the resulting solution was adjusted to pH 10 with potassium carbonate.

Further, the layer strength of the samples was evaluated by the following bond performance.

An adhesive tape having a high adhesive power was taped on the sample and rubbed 10 times. After the sample was left to stand at room temperature for one day, the tape was peeled off and the strength of the adhesion of the layer was compared. More specifically, the peeled-off area was organoleptically compared. The more the peeled-off area, the results become worse. The evaluation was made by the following criteria:

The mark ○: very good

The mark Δ: fair

The mark X: bad

The results are shown in Table 1.

It is apparent from Table 1 that the samples obtained by using the polymers of the present invention are excellent in the absorption characteristics of the dyes, the decolorizability of the dyes and the physical properties of the layer.

EXAMPLE 2

The following layers having the following compositions were coated on an undercoated cellulose triacetate film support to prepare a multi-layer light-sensitive material designated as Sample 201.

Composition of light-sensitive layer

Numerals in the right-hand column represent coating weights (g/m²) of ingredients. The amounts of silver halide emulsions are represented by the coating weight in terms of silver. The coating weights of sensitizing dyes are represented by moles per mol of silver halide in the same layer.

| Sample 201 | |
|---|---|
| First layer (antihalation layer) | |
| Black colloidal silver | 0.18 as Ag |
| Gelatin | 1.40 |
| Second layer (interlayer) | |
| 2,5-Di-t-pentadecylhydroquinone | 0.18 |
| EX-1 | 0.18 |
| EX-3 | 0.020 |
| EX-12 | $2.0 \times 10^{-3}$ |
| U-1 | 0.060 |
| U-2 | 0.080 |
| U-3 | 0.10 |
| HBS-1 | 0.10 |

-continued

| Sample 201 | |
|---|---|
| HBS-2 | 0.020 |
| Gelatin | 1.04 |
| Third layer (first red-sensitive emulsion layer) | |
| Emulsion A | 0.20 as Ag |
| Emulsion B | 0.30 as Ag |
| Sensitizing dye I | $6.9 \times 10^{-5}$ |
| Sensitizing dye II | $1.8 \times 10^{-5}$ |
| Sensitizing dye III | $3.1 \times 10^{-4}$ |
| EX-2 | 0.17 |
| EX-10 | 0.020 |
| EX-14 | 0.17 |
| U-1 | 0.070 |
| U-2 | 0.050 |
| U-3 | 0.070 |
| HBS-1 | 0.060 |
| Gelatin | 0.87 |
| Fourth layer (second red-sensitive emulsion layer) | |
| Emulsion D | 0.85 as Ag |
| Sensitizing dye I | $3.5 \times 10^{-4}$ |
| Sensitizing dye II | $1.6 \times 10^{-5}$ |
| Sensitizing dye III | $5.1 \times 10^{-4}$ |
| EX-2 | 0.20 |
| EX-3 | 0.050 |
| EX-10 | 0.015 |
| EX-14 | 0.20 |
| EX-15 | 0.050 |
| U-1 | 0.070 |
| U-2 | 0.050 |
| U-3 | 0.070 |
| Gelatin | 1.30 |
| Fifth layer (third red-sensitive emulsion layer) | |
| Emulsion E | 1.55 as Ag |
| Sensitizing dye I | $2.4 \times 10^{-4}$ |
| Sensitizing dye II | $1.0 \times 10^{-4}$ |
| Sensitizing dye III | $3.4 \times 10^{-4}$ |
| EX-2 | 0.097 |
| EX-3 | 0.010 |
| EX-4 | 0.080 |
| HBS-1 | 0.22 |
| HBS-2 | 0.10 |
| Gelatin | 1.63 |
| Sixth layer (interlayer) | |
| EX-5 | 0.040 |
| HBS-1 | 0.020 |
| Gelatin | 0.80 |
| Seventh layer (first green-sensitive emulsion layer) | |
| Emulsion C | 0.40 as Ag |
| Sensitizing dye IV | $2.6 \times 10^{-5}$ |
| Sensitizing dye V | $1.8 \times 10^{-4}$ |
| Sensitizing dye VI | $6.9 \times 10^{-4}$ |
| EX-1 | 0.015 |
| EX-6 | 0.13 |
| EX-7 | 0.020 |
| EX-8 | 0.025 |
| EX-16 | 0.015 |
| HBS-1 | 0.10 |
| HBS-3 | 0.010 |
| Gelatin | 0.63 |
| Eighth layer (second green-sensitive emulsion layer) | |
| Emulsion D | 0.55 as Ag |
| Sensitizing dye IV | $2.1 \times 10^{-5}$ |
| Sensitizing dye V | $1.5 \times 10^{-4}$ |
| Sensitizing dye VI | $5.8 \times 10^{-4}$ |
| EX-6 | 0.047 |
| EX-7 | 0.018 |
| EX-8 | 0.018 |
| EX-16 | 0.054 |
| HBS-1 | 0.16 |
| HBS-3 | $8.0 \times 10^{-3}$ |

-continued

| Sample 201 | |
|---|---|
| Gelatin | 0.50 |
| Ninth layer (third green-sensitive emulsion layer) | |
| Emulsion E | 1.10 as Ag |
| Sensitizing dye IV | $4.6 \times 10^{-5}$ |
| Sensitizing dye V | $1.0 \times 10^{-4}$ |
| Sensitizing dye VI | $4.0 \times 10^{-4}$ |
| EX-1 | 0.013 |
| EX-11 | 0.060 |
| EX-13 | 0.025 |
| HBS-1 | 0.15 |
| HBS-2 | 0.05 |
| Gelatin | 1.25 |
| Tenth layer (yellow filter layer) | |
| Yellow colloidal silver | 0.055 as Ag |
| EX-5 | 0.12 |
| HBS-2 | 0.08 |
| Gelatin | 0.60 |
| Eleventh layer (first blue-sensitive emulsion layer) | |
| Emulsion C | 0.20 as Ag |
| Sensitizing dye VII | $8.6 \times 10^{-4}$ |
| EX-8 | 0.042 |
| EX-9 | 0.72 |
| HBS-1 | 0.28 |
| Gelatin | 1.10 |
| Twelfth layer (second blue-sensitive emulsion layer) | |
| Emulsion D | 0.45 as Ag |
| Sensitizing dye VII | $7.4 \times 10^{-4}$ |
| EX-9 | 0.15 |
| EX-10 | $7.0 \times 10^{-3}$ |
| HBS-1 | 0.050 |
| Gelatin | 0.78 |

-continued

| Sample 201 | |
|---|---|
| Thirteenth layer (third blue-sensitive emulsion layer) | |
| Emulsion F | 0.80 as Ag |
| Sensitizing dye VII | $2.8 \times 10^{-4}$ |
| EX-9 | 0.20 |
| HBS-1 | 0.070 |
| Gelatin | 0.69 |
| Fourteenth layer (first protective layer) | |
| Emulsion G | 0.20 as Ag |
| U-4 | 0.11 |
| U-5 | 0.17 |
| HBS-1 | $5.0 \times 10^{-2}$ |
| Gelatin | 1.00 |
| Fifteenth layer (second protective layer) | |
| H-1 | 0.40 |
| B-1 (diameter 1.7 μm) | $5.0 \times 10^{-2}$ |
| B-2 (diameter 1.7 μm) | 0.10 |
| B-3 | 0.10 |
| S-1 | 0.20 |
| Gelatin | 1.20 |

Further, all layers contained W-1, W-2, W-3, B-4, B-5, B-6, F-1, F-2, F-3, F-4, F-5, F-6, F-7, F-8, F-9, F-10, F-11, F-12, F-13, F-14, F-15, F-16, iron salt, lead salt, gold salt, platinum salt, palladium salt, iridium salt and rhodium salt to improve preservability, processability, pressure resistance, antifungal and antimicrobial properties, antistatic properties and coatability.

The above-described emulsions A to G are shown in Table 2.

TABLE 2

| | Average AgI content (%) | Mean grain size (μm) | Coefficient of variation in grain size (%) | Ratio of diameter/thickness | Ratio of silver amount [core/intermediate/shell] (AgI content) | Grain structure/form |
|---|---|---|---|---|---|---|
| Emulsion | | | | | | |
| A | 4.0 | 0.45 | 27 | 1 | [1/3] (13/1) | double structural octahedral grains |
| B | 8.9 | 0.70 | 14 | 1 | [3/7] (25/2) | double structural octahedral grains |
| C | 2.0 | 0.55 | 25 | 7 | — | uniform structural tabular grains |
| D | 9.0 | 0.65 | 25 | 6 | [12/59/29] (0/11/8) | triple structural tabular grains |
| E | 9.0 | 0.85 | 23 | 5 | [8/59/33] (0/11/8) | triple structural tabular grains |
| F | 14.5 | 1.25 | 25 | 3 | [37/63] (34/3) | double structural tabular grains |
| G | 1.0 | 0.07 | 15 | 1 | — | uniform structural fine grains |

(1) In the preparation of the emulsions C, D, E and F, reduction sensitization was conducted during the formation of grains by using thiourea dioxide and thiosulfonic acid according to the Examples of JP-A-191938.

(2) The emulsions C, D, E and F were subjected to gold sensitization, sulfur sensitization and selenium sensitization in the presence of spectral sensitizing dyes used in each light-sensitive layer and sodium thiocyanate according to the Examples of JP-A-3-237450.

(3) Low-molecular gelatin was used in the preparation of tabular grains according to the Examples of JP-A-1-158426.

(4) When tabular grains and grains having a normal crystal form were inspected through a high pressure electron microscope, transition lines as described in JP-A-3-237450 were found.

EX-1

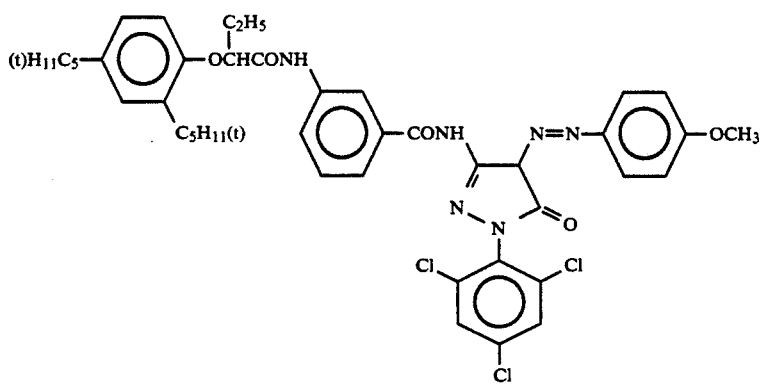

-continued
EX-2
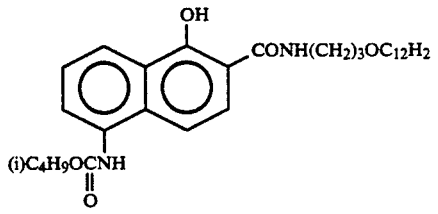
EX-3
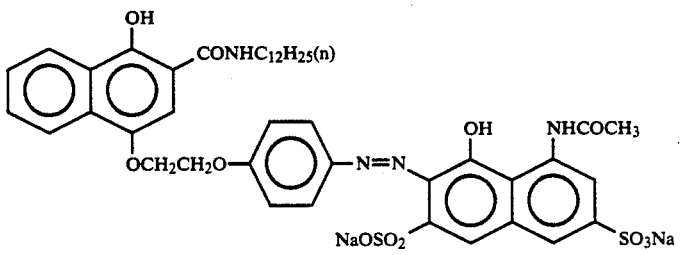
EX-4
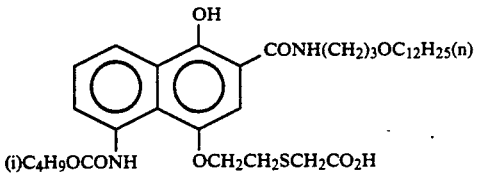
EX-5
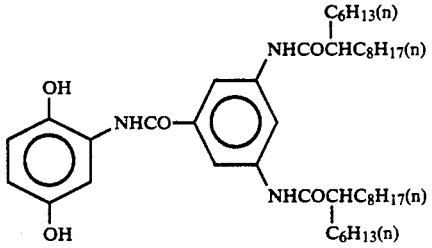
EX-6
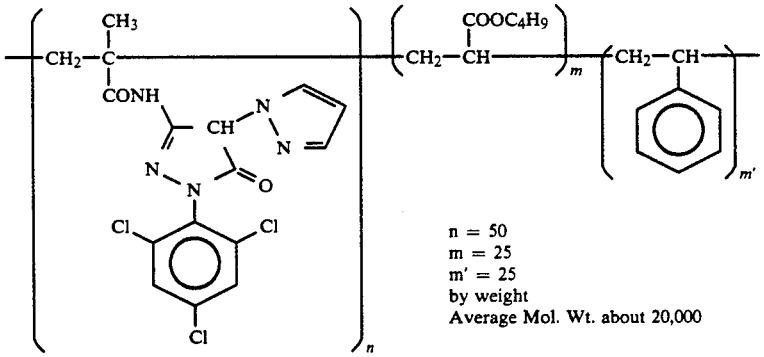
EX-7
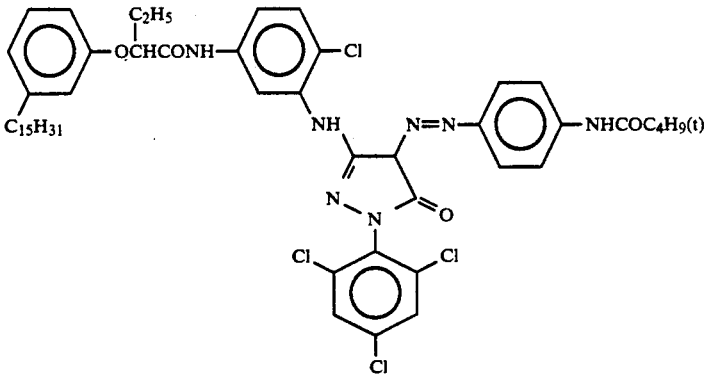

-continued
EX-8
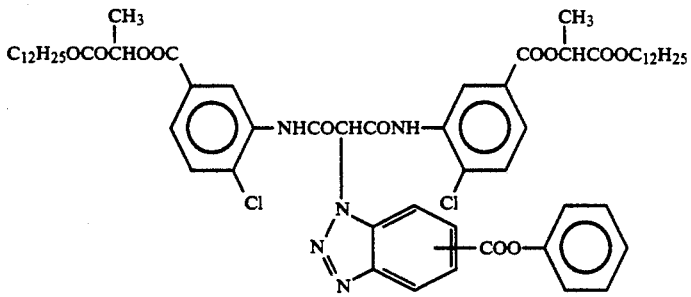
EX-9
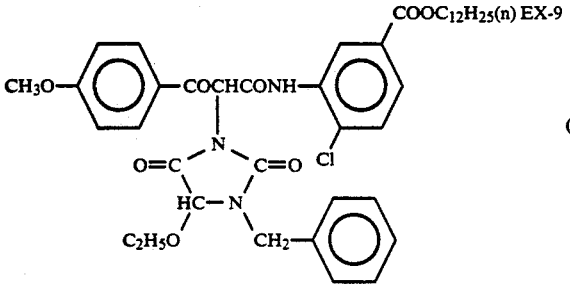
EX-10
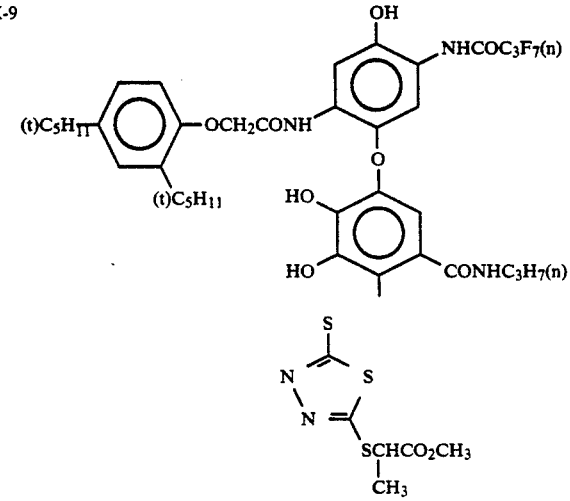
EX-11
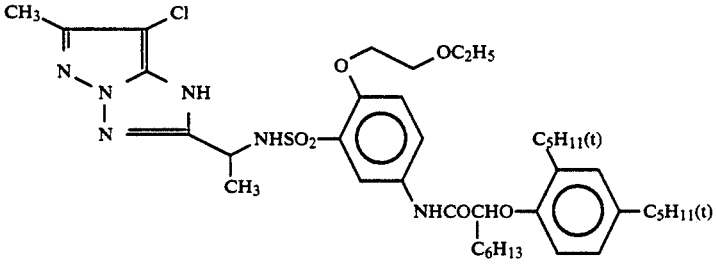
EX-12
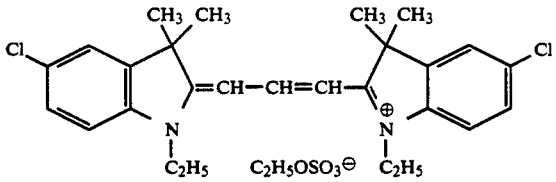
EX-13
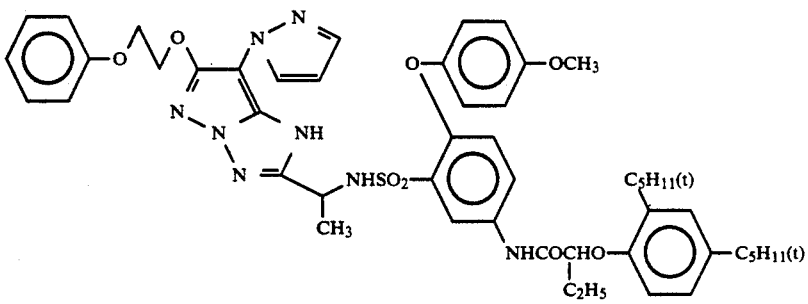

-continued
EX-14
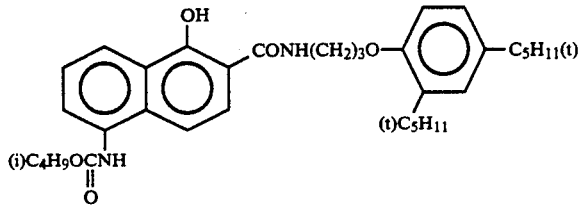
EX-15
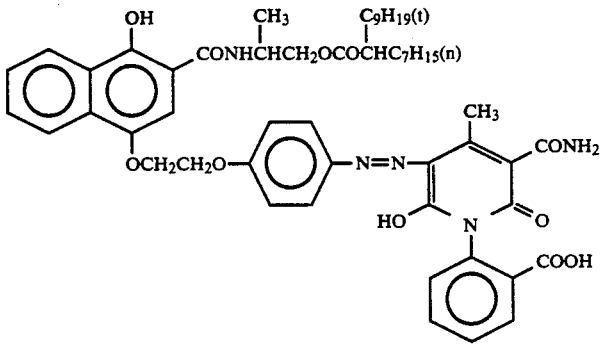
EX-16
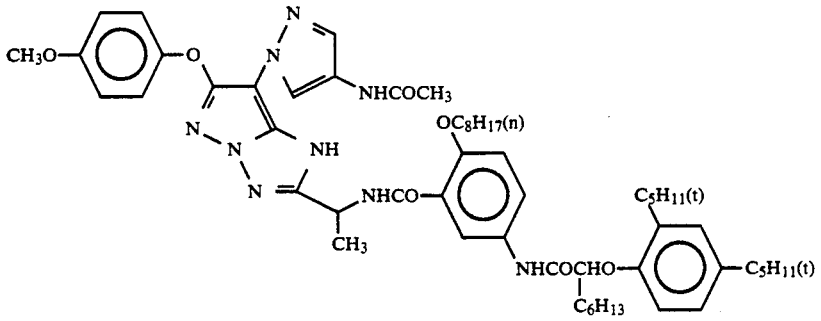
U-1
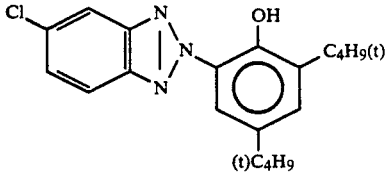
U-2
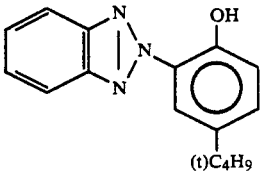
U-3
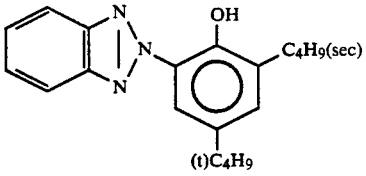
U-4
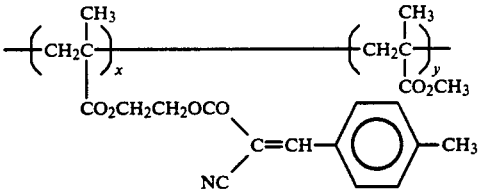
x:y = 70:30 (wt %)
U-5
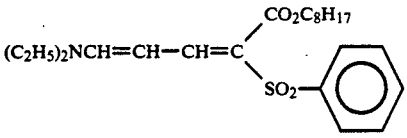
Tricresyl phosphate HBS-1
Di-n-butyl phthalate HBS-2
HBS-3
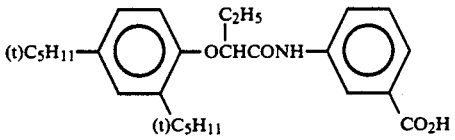

-continued
Sensitizing dye I
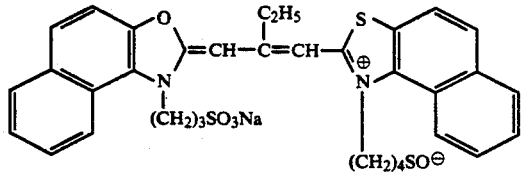
Sensitizing dye II
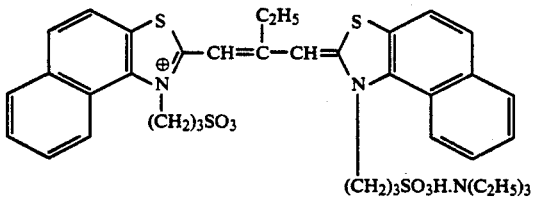
Sensitizing dye III
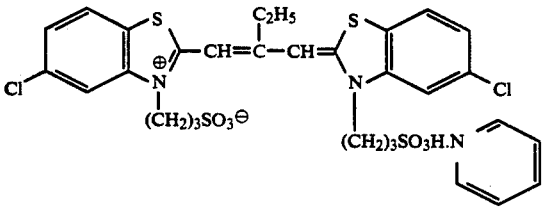
Sensitizing dye IV
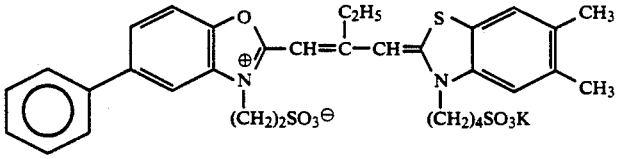
Sensitizing dye V
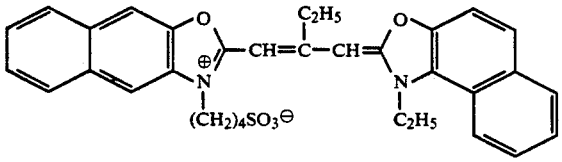
Sensitizing dye VI
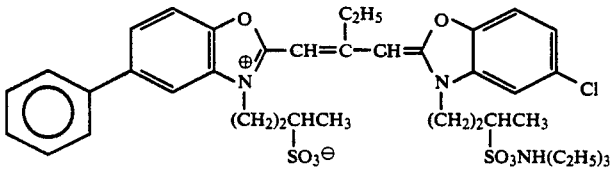
Sensitizing dye VII
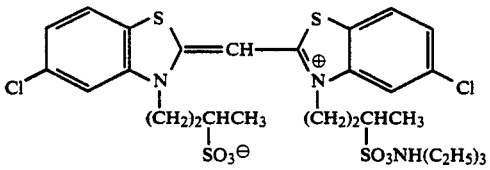
S-1
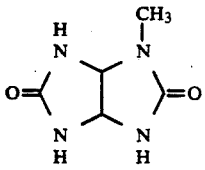
H-1
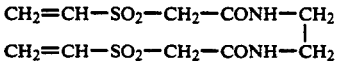
B-1
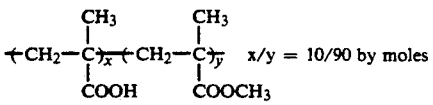
x/y = 10/90 by moles
B-2
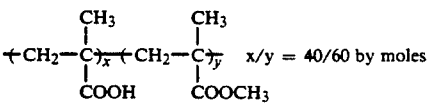
x/y = 40/60 by moles -continued
B-3
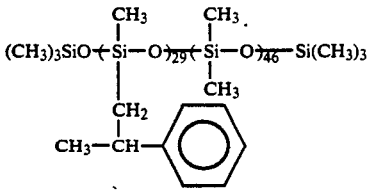
B-4
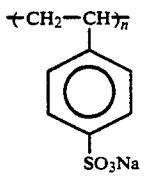
B-5
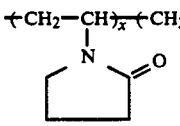
x/y = 70/30 by moles
B-6
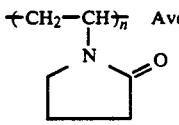
Average Mol. Wt. about 10,000
W-1
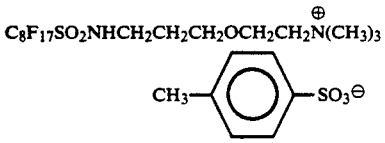
W-2
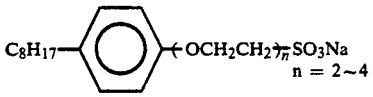
n = 2~4
W-3
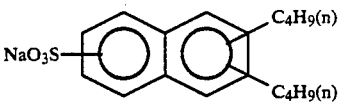
F-1
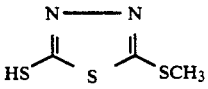
F-2
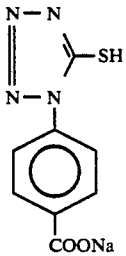
F-3
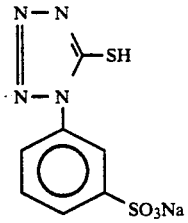
F-4
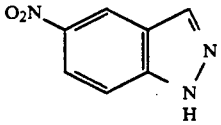
F-5
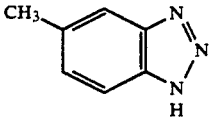
F-6
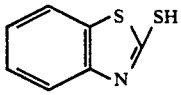
F-7
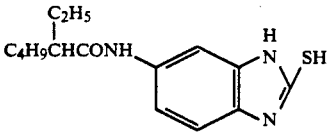
F-8
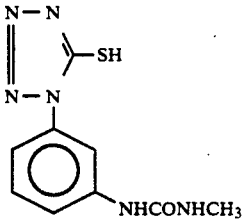
F-9
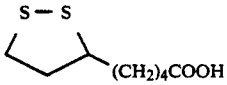
F-10
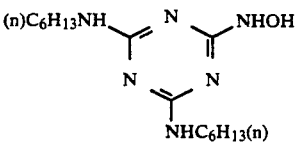
F-11
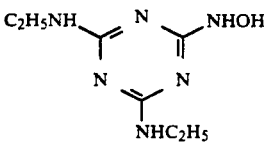

-continued

F-12

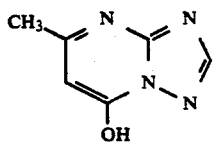

F-13

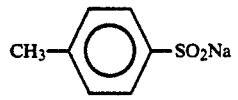

F-14

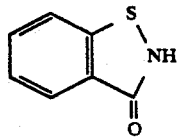

F-15

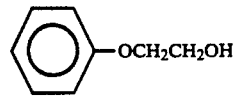

F-16

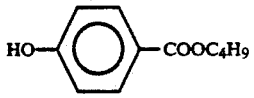

Preparation of Sample 202

Sample 202 was prepared in the same manner as in the preparation of Sample 201 except that Dye D-27 (0.20 g/m$^2$) of the present invention was used in place of the yellow colloidal silver used in the tenth layer of Sample 201 and High-boiling Organic Solvent HBS-2 was used in an amount of 0.40 g/m$^2$ as the dispersion medium in the tenth layer.

Preparation of Samples 203 and 204

Each of Samples 203 and 204 was prepared in the same manner as in the preparation of Sample 202 except that an equal weight of each of Comparative Polymers Polymer A and Polymer B was used in place of High-boiling Organic Solvent HBS-2 used in the tenth layer of Sample 202.

Preparation of Samples 205 and 206

Each of Samples 205 and 206 was prepared in the same manner as in the preparation of Sample 202 except that each of an equal weight of the Polymers P-2 and P-16 of the present invention was used in place of the High-boiling Organic Solvent HBS-2 used in the tenth layer of Sample 202.

The thus-obtained samples were exposed to white light through an optical wedge and processed in an automatic processor in the following manner (previously, processing was carried out until the accumulated replenishment rate of the processing solution reached three times the tank capacity of the mother solution).

| | Processing Method (A) | | | |
|---|---|---|---|---|
| Stage | Processing Time | Processing Temperature (° C.) | Replenishment rate (ml) | Tank capacity (l) |
| Color development | 3 min. 15 sec. | 38 | 33 | 20 |
| Bleaching | 6 min. 30 sec. | 38 | 25 | 40 |
| Rinse | 2 min. 10 sec. | 24 | 1200 | 20 |
| Fixing | 4 min. 20 sec. | 38 | 25 | 30 |
| Rinse (1) | 1 min. 05 sec. | 24 | countercurrent piping system of from (2) to (1) | 10 |
| Rinse (2) | 1 min. 00 sec. | 24 | 1200 | 10 |
| Stabilization | 1 min. 05 sec. | 38 | 25 | 10 |

-continued

| | Processing Method (A) | | | |
|---|---|---|---|---|
| Stage | Processing Time | Processing Temperature (° C.) | Replenishment rate (ml) | Tank capacity (l) |
| Drying | 4 min. 20 sec. | 55 | | |

Replenishment rate being per 1 m long by 35 mm wide.

Each processing solution had the following composition.

| | Mother Solution (g) | Replenisher (g) |
|---|---|---|
| Color developing solution | | |
| Diethylenetriaminepentaacetic acid | 1.0 | 1.1 |
| 1-Hydroxyethylidene-1,1-diphosphonic acid | 3.0 | 3.2 |
| Sodium sulfite | 4.0 | 4.4 |
| Potassium carbonate | 30.0 | 37.0 |
| Potassium bromide | 1.4 | 0.7 |
| Potassium iodide | 1.5 mg | — |
| Hydroxylamine sulfate | 2.4 | 2.8 |
| 4-[N-Ethyl-N-β-hydroxyethylamino]-2-methylaniline sulfate | 4.5 | 5.5 |
| Water to make | 1.0 liter | 1.0 liter |
| pH | 10.05 | 10.10 |
| Bleaching solution | | |
| Sodium ethylenediaminetetraacetato ferrate trihydrate | 100.0 | 120.0 |
| Disodium ethylenediaminetetraacetate | 10.0 | 10.0 |
| Ammonium bromide | 140.0 | 160.0 |
| Ammonium nitrate | 30.0 | 35.0 |
| Ammonia water (27%) | 6.5 ml | 4.0 ml |
| Water to make | 1.0 liter | 1.0 liter |
| pH | 6.0 | 5.7 |
| Fixing solution | | |
| Disodium ethylenediaminetetraacetate | 0.5 | 0.7 |
| Sodium sulfite | 7.0 | 8.0 |
| Sodium bisulfite | 5.0 | 5.5 |
| Aqueous solution of ammonium thiosulfate (70%) | 170.0 ml | 200.0 ml |
| Water to make | 1.0 liter | 1.0 liter |
| pH | 6.7 | 6.6 |
| Stabilizing solution | | |
| Formalin (37%) | 2.0 ml | 3.0 ml |
| Polyoxyethylene p-monononylphenyl ether (average degree of polymerization: 10) | 0.3 | 0.45 |
| Disodium ethylenediamine- | 0.05 | 0.08 |

-continued

| | Mother Solution (g) | Replenisher (g) |
|---|---|---|
| tetraacetate | | |
| Water to make | 1.0 liter | 1.0 liter |
| pH | 5.0–8.0 | 5.0–8.0 |

After processing, the density of each sample was measured. The density ($D_B$(min)) of the fogged area of the blue-sensitive layer was read out in terms of the relative value when the density of Sample 201 was referred to as standard, and ($\Delta D_B$(min)) was determined to make the evaluation of the decolorizability of the dye.

The sensitivity of the green-sensitive layer was evaluated in terms of the relative sensitivity when the sensitivity of Sample 201 was referred to as standard (100).

It is apparent from Table 3 that the samples of the present invention gave a $D_B$(min) substantially equal to that of Sample 201. This shows excellent decolorizability of the dye. Further, the sensitivity of the green-sensitive layer is greatly increased in the samples of the present invention. This is because the dyes of the present invention have excellent absorption characteristics. Further, the evaluation of function as a yellow filter was made in the following manner. The evaluation was made in terms of the magenta density obtained by the exposure of the green-sensitive layer to the transmitted blue light which was transmitted to the lower layer without being absorbed by a yellow filter when the yellow colloidal silver (filter) in the tenth layer of Sample 201 was removed. Namely, each sample was subjected to blue color separation exposure, and processed by the above-described Processing Method A, and the magenta density was measured. The level of the magenta density of the sample, when the yellow filter was removed, was referred to as light leak=100%, and the level of the magenta density of Sample 201 was referred to as 0%. Evaluation was made on the basis of these levels.

It is apparent from Table 3 that the samples of the present invention have a yellow filter effect substantially equal to that of Sample 201 and prevent blue light from being transmitted to the lower layer.

TABLE 3

| | Dye in the 10th layer | Dispersion medium in the 10th layer | Leak of blue light through yellow filter (%) | Difference (ΔDmin) in Dmin of yellow density | Relative sensitivity of green-sensitive layer | Adhesion |
|---|---|---|---|---|---|---|
| Sample 201 (Comp. Ex.) | — | — | 0 | ±0 | 100 | ○ |
| Sample 202 (Comp. Ex.) | D-27 | HBS-2 | 10 | ±0.01 | 119 | X |
| Sample 203 (Comp. Ex.) | D-27 | Polymer-1 | 30 | ±0.03 | 115 | ○ |
| Sample 204 (Comp. Ex.) | D-27 | Polymer-2 | 35 | ±0.02 | 115 | ○ |
| Sample 205 (Invention) | D-27 | P-2 | 0 | ±0.01 | 120 | ○ |
| Sample 206 (Invention) | D-27 | P-16 | 0 | ±0.01 | 120 | ○ |

It is apparent from Table 3 that the samples of the present invention are excellent in decolorizability and the physical properties of the layers and have increased sensitivity. In another experiment, the above samples were processed by the following Processing Method B. It was found that the samples of the present invention are excellent in decolorizability, and the sensitivity of the lower green-sensitive layer of the samples of the present invention is greatly increased as in the case where the samples are processed by the Processing Method A.

Processing Method B

| Stage | Processing Time | Processing Temperature (°C.) | Replenishment rate (ml) | Tank capacity (l) |
|---|---|---|---|---|
| Color development | 3 min. 15 sec. | 37.8 | 25 | 10 |
| Bleaching | 45 sec. | 38 | 5 | 4 |
| Bleaching-fixing (1) | 45 sec. | 38 | — | 4 |
| Bleaching-fixing (2) | 45 sec. | 38 | 30 | 4 |
| Rinse (1) | 20 sec. | 38 | — | 2 |
| Rinse (2) | 20 sec. | 38 | 30 | 2 |
| Stabilization | 20 sec. | 38 | 20 | 2 |
| Drying | 1 min. | 55 | | |

*Replenishment rate being per 1 m long by 35 mm wide.

A countercurrent system of from (2) to (1) was used in the bleaching-fixing stage and in the rinsing stage. All of the overflow solution of the bleaching solution was introduced into the bleaching-fixing stage.

The amount of the bleaching-fixing solution brought over from the bleaching-fixing stage into the rinsing stage in the above processing was 2 ml per 1 m long by 35 mm wide of the photographic material.

| | Mother Solution (g) | Replenisher (g) |
|---|---|---|
| Color developing solution | | |
| Diethylenetriaminepentaacetic acid | 5.0 | 6.0 |
| Sodium sulfite | 4.0 | 5.0 |
| Potassium carbonate | 30.0 | 37.0 |
| Potassium bromide | 1.3 | 0.5 |
| Potassium iodide | 1.2 mg | — |
| Hydroxylamine sulfate | 2.0 | 3.6 |
| 4-[N-Ethyl-N-β-hydroxyethylamino]-2-methylaniline sulfate | 4.7 | 6.2 |
| Water to make | 1.0 liter | 1.0 liter |
| pH | 10.00 | 10.15 |
| Bleaching solution | | |
| Ammonium 1,3-diaminopropanetetraacetato ferrate monohydrate | 144.0 | 206.0 |
| 1,3-Diaminopropanetetraacetic acid | 2.8 | 4.0 |

-continued

| | Mother Solution (g) | Replenisher (g) |
|---|---|---|
| Ammonium bromide | 84.0 | 120.0 |
| Ammonium nitrate | 17.5 | 25.0 |
| Ammonia water (27%) | 10.0 | 1.8 |
| Acetic acid (98%) | 51.1 | 73.0 |
| Water to make | 1.0 liter | 1.0 liter |
| pH | 4.3 | 3.4 |
| Bleaching-fixing solution | | |
| Ammonium ethylenediamine-tetraacetato ferrate dihydrate | 50.0 | — |
| Disodium ethylenediamine-tetraacetate | 5.0 | 25.0 |
| Ammonium sulfite | 12.0 | 20.0 |
| Aqueous solution of ammonium thiosulfate (700 g/l) | 290.0 ml | 320.0 ml |
| Ammonia water (27%) | 6.0 ml | 15.0 ml |
| Water to make | 1.0 liter | 1.0 liter |
| pH | 6.8 | 8.0 |

Rinsing water

Mother solution and replenisher were the same.

Tap water was passed through a mixed bed column packed with an H type strongly acidic cation exchange resin (Amberlite IR-120B manufactured by Rohm & Haas Co.) and an OH type strongly basic anion exchange resin (Amberlite IRA-400) to reduce the concentration of each of calcium ion and magnesium ion to not higher than 3 mg/l. Subsequently, sodium dichlorinated isocyanurate (20 mg/l) and sodium sulfate (150 mg/l) were added thereto. The pH of the solution was in the range of 6.5 to 7.5.

Stabilizing solution

Mother solution and replenisher were the same.

| | |
|---|---|
| Formalin (37%) | 1.2 ml |
| Surfactant $[C_{10}H_{21}—O—(CH_2CH_2O)_{10}—H]$ | 0.4 g |

EXAMPLE 3

Preparation of Sample 301

The following layers having the following compositions were coated on an undercoated cellulose triacetate support of 127 μm in thickness to prepare a multi-layer color light-sensitive material designated as Sample 301. Numerals in the right-hand column represent coating weight per $m^2$. The effects of compounds added are not limited to those described below.

| | |
|---|---|
| First layer (antihalation layer) | |
| Black colloidal silver | 0.20 g as Ag |
| Gelatin | 1.9 g |
| Ultraviolet light absorber U-1 | 0.1 g |
| Ultraviolet light absorber U-3 | 0.04 g |
| Ultraviolet light absorber U-4 | 0.1 g |
| High-boiling organic solvent Oil-1 | 0.1 g |
| Second layer (interlayer) | |
| Gelatin | 0.40 g |
| Compound Cpd-C | 5 mg |
| Compound Cpd-J | 5 mg |
| Compound Cpd-K | 3 mg |
| High boiling organic solvent Oil-3 | 0.1 g |
| Dye D-4 | 0.4 mg |
| Third layer (interlayer) | |
| Fine grain silver iodobromide emulsion (wherein the interiors of the grains were fogged) (mean grain size: 0.06 μm, coefficient of variation: 18%, AgI content: 1 mol %) | 0.05 g as Ag |
| Gelatin | 0.4 g |
| Fourth layer (low-sensitivity red-sensitive emulsion layer) | |
| Emulsion A | 0.1 g as Ag |
| Emulsion B | 0.4 g as Ag |
| Gelatin | 0.8 g |
| Coupler C-1 | 0.15 g |
| Coupler C-2 | 0.05 g |
| Coupler C-3 | 0.05 g |
| Coupler C-9 | 0.05 g |
| Compound Cpd-C | 10 mg |
| High-boiling organic solvent Oil-2 | 0.1 g |
| Additive P-1 | 0.1 g |
| Fifth layer (intermediate-sensitivity red-sensitive emulsion layer) | |
| Emulsion B | 0.2 g as Ag |
| Emulsion C | 0.3 g as Ag |
| Gelatin | 0.8 g |
| Coupler C-1 | 0.2 g |
| Coupler C-2 | 0.05 g |
| Coupler C-3 | 0.2 g |
| High-boiling organic solvent Oil-2 | 0.1 g |
| Additive P-1 | 0.1 g |
| Sixth layer (high-sensitivity red-sensitive emulsion layer) | |
| Emulsion D | 0.4 g as Ag |
| Gelatin | 1.1 g |
| Coupler C-1 | 0.3 g |
| Coupler C-2 | 0.1 g |
| Coupler C-3 | 0.7 g |
| Additive P-1 | 0.1 g |
| Seventh layer (interlayer) | |
| Gelatin | 0.6 g |
| Additive M-1 | 0.3 g |
| Color mixing inhibitor Cpd-I | 2.0 mg |
| Ultraviolet light absorber U-1 | 0.01 g |
| Ultraviolet light absorber U-2 | 0.002 g |
| Ultraviolet light absorber U-5 | 0.01 g |
| Dye D-1 | 0.02 g |
| Compound Cpd-C | 5 mg |
| Compound Cpd-J | 5 mg |
| Compound Cpd-K | 5 mg |
| High-boiling organic solvent Oil-1 | 0.02 g |
| Eighth layer (interlayer) | |
| Silver iodobromide emulsion wherein the surfaces and interiors of the grains were fogged (mean grain size: 0.06 μm, coefficient of variation: 16%, AgI content: 0.3 mol %) | 0.02 g as Ag |
| Gelatin | 1.0 g |
| Additive P-1 | 0.2 g |
| Color mixing inhibitor Cpd-A | 0.1 g |
| Ninth layer (low-sensitivity green-sensitive emulsion layer) | |
| Emulsion E | 0.1 g as Ag |
| Emulsion F | 0.2 g as Ag |
| Emulsion G | 0.2 g as Ag |
| Gelatin | 0.5 g |
| Coupler C-4 | 0.1 g |
| Coupler C-7 | 0.05 g |
| Coupler C-8 | 0.20 g |
| Compound Cpd-B | 0.03 g |
| Compound Cpd-C | 10 mg |
| Compound Cpd-D | 0.02 g |
| Compound Cpd-E | 0.02 g |
| Compound Cpd-F | 0.02 g |
| Compound Cpd-G | 0.02 g |
| High-boiling organic solvent Oil-1 | 0.1 g |
| High-boiling organic solvent Oil-2 | 0.1 g |
| Tenth layer (intermediate-sensitivity green-sensitive emulsion layer) | |
| Emulsion G | 0.3 g as Ag |
| Emulsion H | 0.1 g as Ag |
| Gelatin | 0.6 g |

-continued

| | |
|---|---|
| Coupler C-4 | 0.1 g |
| Coupler C-7 | 0.2 g |
| Coupler C-8 | 0.1 g |
| Compound Cpd-B | 0.03 g |
| Compound Cpd-D | 0.02 g |
| Compound Cpd-E | 0.02 g |
| Compound Cpd-F | 0.05 g |
| Compound Cpd-G | 0.05 g |
| High-boiling organic solvent Oil-2 | 0.01 g |
| Eleventh layer (high-sensitivity green-sensitive emulsion layer) | |
| Emulsion I | 0.5 g as Ag |
| Gelatin | 1.0 g |
| Coupler C-4 | 0.3 g |
| Coupler C-7 | 0.1 g |
| Coupler C-8 | 0.1 g |
| Compound Cpd-B | 0.08 g |
| Compound Cpd-C | 5 mg |
| Compound Cpd-D | 0.02 g |
| Compound Cpd-E | 0.02 g |
| Compound Cpd-F | 0.02 g |
| Compound Cpd-G | 0.02 g |
| Compound Cpd-J | 5 mg |
| Compound Cpd-K | 5 mg |
| High-boiling organic solvent Oil-1 | 0.02 g |
| High-boiling organic solvent Oil-2 | 0.02 g |
| Twelfth layer (interlayer) | |
| Gelatin | 0.6 g |
| Thirteenth layer (yellow filter layer) | |
| Yellow colloidal silver | 0.07 g as Ag |
| Gelatin | 1.1 g |
| Color mixing inhibitor Cpd-A | 0.01 g |
| High-boiling organic solvent Oil 1 | 0.01 g |
| Fourteenth layer (interlayer) | |
| Gelatin | 0.6 g |
| Fifteenth layer (low-sensitivity blue-sensitive emulsion layer) | |
| Emulsion J | 0.2 g as Ag |
| Emulsion K | 0.3 g as Ag |
| Emulsion L | 0.1 g as Ag |
| Gelatin | 0.8 g |
| Coupler C-5 | 0.2 g |
| Coupler C-6 | 0.1 g |
| Coupler C-10 | 0.4 g |
| Sixteenth layer (intermediate-sensitivity blue-sensitive emulsion layer) | |
| Emulsion L | 0.1 g as Ag |
| Emulsion M | 0.4 g as Ag |
| Gelatin | 0.9 g |
| Coupler C-5 | 0.3 g |
| Coupler C-6 | 0.1 g |
| Coupler C-10 | 0.1 g |
| Seventeenth layer (high-sensitivity blue-sensitive emulsion layer) | |
| Emulsion N | 0.4 g as Ag |
| Gelatin | 1.2 g |
| Coupler C-5 | 0.3 g |

-continued

| | |
|---|---|
| Coupler C-6 | 0.6 g |
| Coupler C-10 | 0.1 g |
| Eighteenth layer (first protective layer) | |
| Gelatin | 0.7 g |
| Ultraviolet light absorber U-1 | 0.2 g |
| Ultraviolet light absorber U-2 | 0.05 g |
| Ultraviolet light absorber U-5 | 0.3 g |
| Formalin scavenger Cpd-H | 0.4 g |
| Dye D-1 | 0.1 g |
| Dye D-2 | 0.05 g |
| Dye D-3 | 0.1 g |
| Nineteenth layer (second protective layer) | |
| Colloidal silver | 0.1 mg as Ag |
| Fine grain silver iodobromide emulsion (mean grain size: 0.06 μm, AgI content: 1 mol %) | 0.1 g as Ag |
| Gelatin | 0.4 g |
| Twentieth layer (third protective layer) | |
| Gelatin | 0.4 g |
| Polymethyl methacrylate (average particle size: 1.5μ) | 0.1 g |
| Methyl methacrylate/acrylic acid (4:6 by moles) copolymer (average particle size: 1.5μ) | 0.1 g |
| Silicone oil | 0.03 g |
| Surfactant W-1 | 3.0 mg |
| Surfactant W-2 | 0.03 g |

Additives F-1 to F-8 in addition to the above-described ingredients were added to all of the emulsion layers. Further, a hardening agent H-1 for gelatin and surfactants W-3, W-4, W-5 and W-6 as coating aids in addition to the above-described ingredients were added to each layer.

Furthermore, phenol, 1,2-benzisothiazoline-3-one, 2-phenoxyethanol, phenethyl alcohol and butyl p-benzoate were added.

The silver iodobromide emulsions used in Sample 301 are shown in Table 4.

TABLE 4

Silver iodobromide emulsions used in Sample 301

| Name Emulsion | Properties of grains | Mean grain size in terms of the average of the diameters of spheres (μm) | Coefficient of variation (%) | AgI content (%) |
|---|---|---|---|---|
| A | Monodisperse tetradecahedral grains | 0.28 | 16 | 3.7 |
| B | Monodisperse cubic internal latent image type grains | 0.30 | 10 | 3.3 |
| C | Monodisperse tabular grains, average aspect ratio: 4.0 | 0.38 | 18 | 5.0 |
| D | Tabular grains, average aspect ratio: 8.0 | 0.68 | 25 | 2.0 |
| E | Monodisperse cubic grains | 0.20 | 17 | 4.0 |
| F | Monodisperse cubic grains | 0.23 | 16 | 4.0 |
| G | Monodisperse cubic internal latent image type grains | 0.28 | 11 | 3.5 |
| H | Monodisperse cubic internal latent image type grains | 0.32 | 9 | 3.5 |
| I | Tabular grains, average aspect ratio: 9.0 | 0.80 | 28 | 1.5 |
| J | Monodisperse tetradecahedral grains | 0.30 | 18 | 4.0 |
| K | Monodisperse tabular grains, average aspect ratio: 7.0 | 0.45 | 17 | 4.0 |
| L | Monodisperse cubic internal latent image type grains | 0.46 | 14 | 3.5 |
| M | Monodisperse tabular grains, average aspect ratio: 10.0 | 0.55 | 13 | 4.0 |
| N | Tabular grains, average aspect ratio: 9.0 | 1.00 | 33 | 1.3 |

TABLE 5

Spectral sensitization of emulsions A to N

| Name of emulsion | Sensitizing dye added | Amount of sensitizing dye added per mol of silver halide (g) |
|---|---|---|
| A | S-1 | 0.025 |
| | S-2 | 0.25 |
| | S-7 | 0.01 |
| B | S-1 | 0.01 |
| | S-2 | 0.25 |
| | S-7 | 0.01 |
| C | S-1 | 0.02 |
| | S-2 | 0.25 |

TABLE 5-continued

Spectral sensitization of emulsions A to N

| Name of emulsion | Sensitizing dye added | Amount of sensitizing dye added per mol of silver halide (g) |
|---|---|---|
| | S-7 | 0.01 |
| D | S-1 | 0.01 |
| | S-2 | 0.10 |
| | S-7 | 0.01 |
| E | S-3 | 0.5 |
| | S-4 | 0.1 |
| F | S-3 | 0.3 |
| | S-4 | 0.1 |
| G | S-3 | 0.25 |
| | S-4 | 0.08 |
| | S-8 | 0.05 |
| H | S-3 | 0.2 |
| | S-4 | 0.06 |
| | S-8 | 0.05 |

TABLE 5-continued

Spectral sensitization of emulsions A to N

| Name of emulsion | Sensitizing dye added | Amount of sensitizing dye added per mol of silver halide (g) |
|---|---|---|
| I | S-3 | 0.3 |
| | S-4 | 0.07 |
| | S-8 | 0.1 |
| J | S-6 | 0.2 |
| | S-5 | 0.05 |
| K | S-6 | 0.2 |
| | S-5 | 0.05 |
| L | S-6 | 0.22 |
| | S-5 | 0.06 |
| M | S-6 | 0.15 |
| | S-5 | 0.04 |
| N | S-6 | 0.22 |
| | S-5 | 0.06 |

C-1

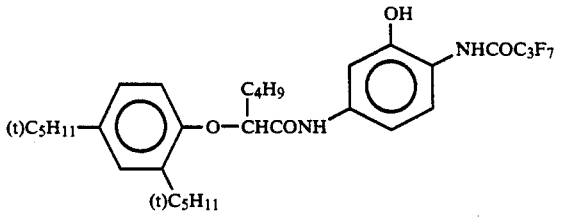

C-2

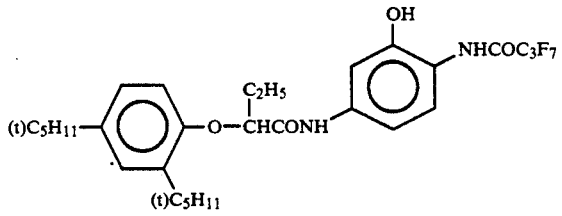

C-3

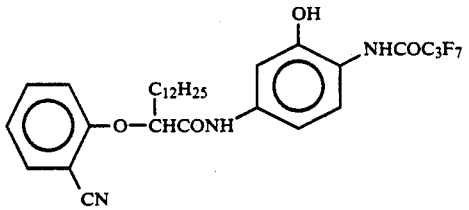

C-4

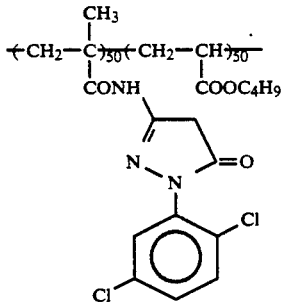

Numeral: wt %
Average Mol. Wt.: about 25,000

-continued
C-5
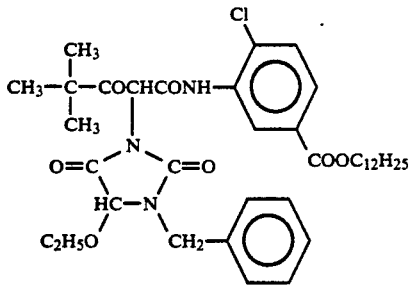
C-6
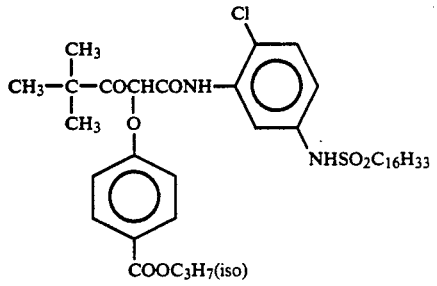
C-7
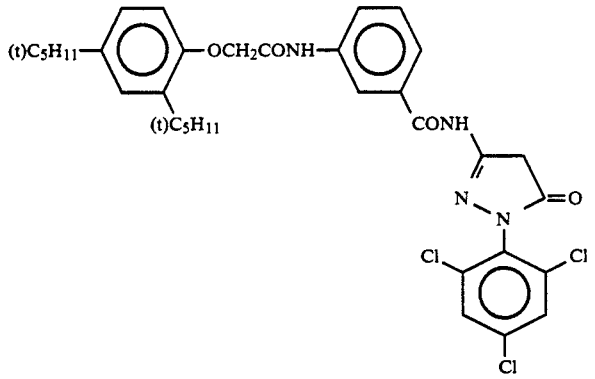
C-8
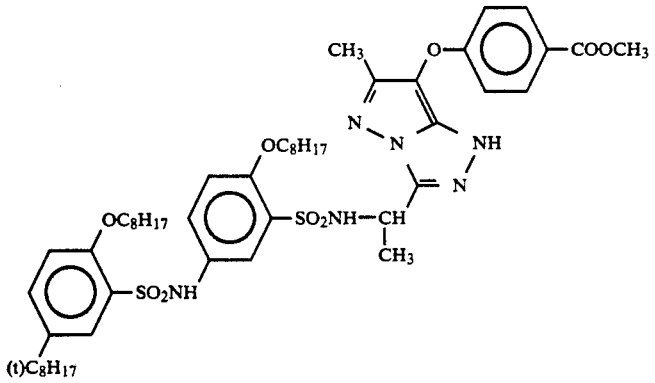
C-9
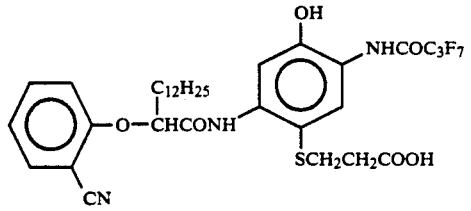

-continued
C-10
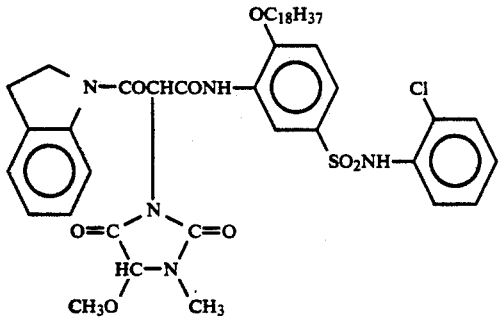
Dibutyl phthalate — Oil-1
Tricresyl phosphate — Oil-2
Oil-3
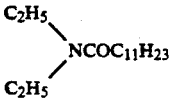
Cpd-A
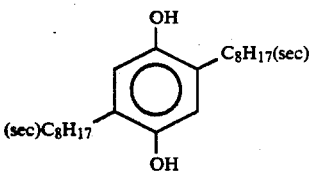
Cpd-B
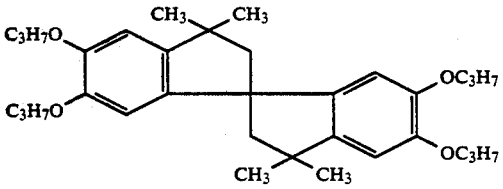
Cpd-C
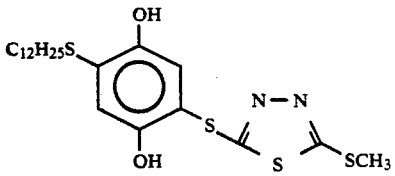
Cpd-D
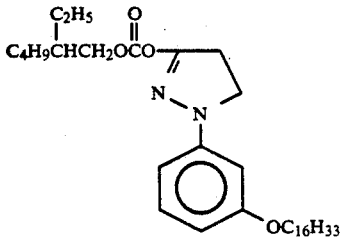
Cpd-E
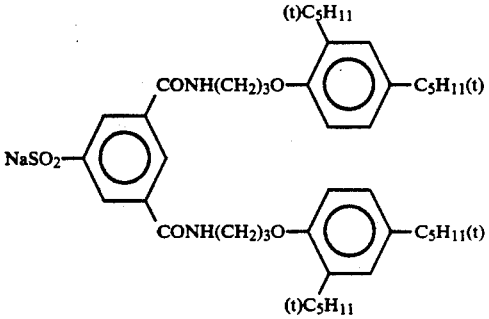

-continued
Cpd-F
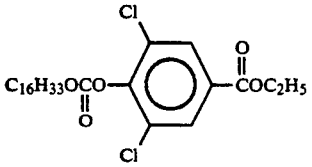
Cpd-G
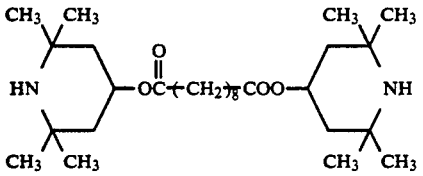
Cpd-H
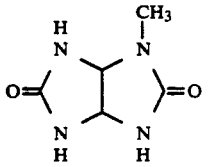
Cpd-I
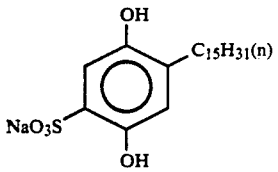
Cpd-J
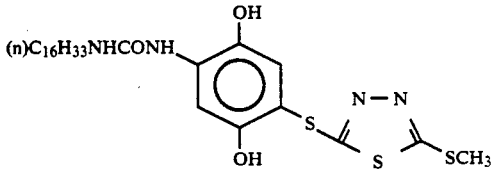
Cpd-K
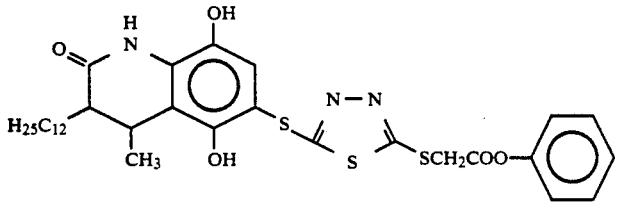
U-1
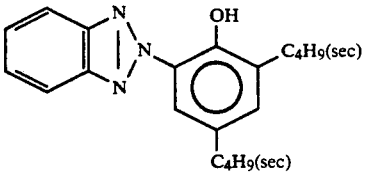
U-2
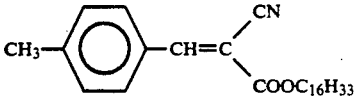
U-3
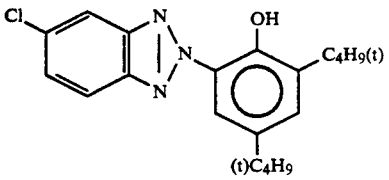

-continued
U-4
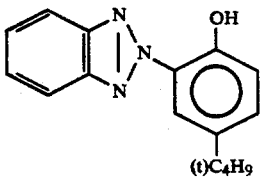
U-5
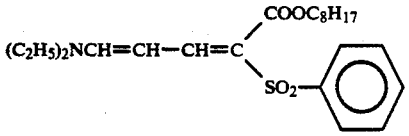
S-1
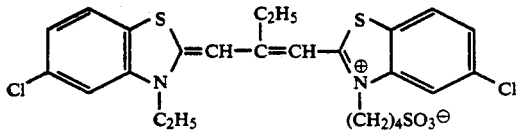
S-2
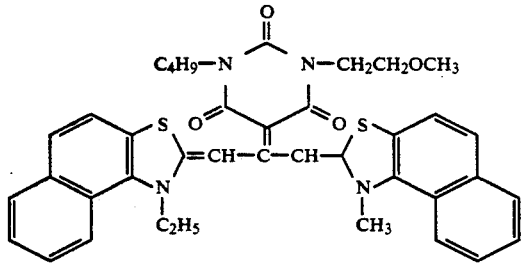
S-3
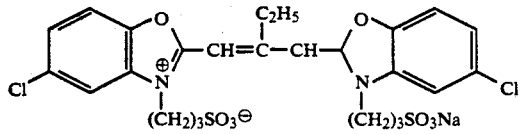
S-4
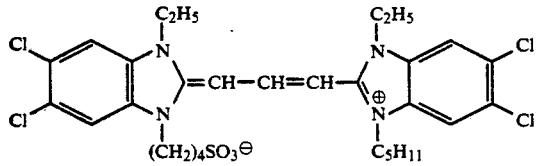
S-5
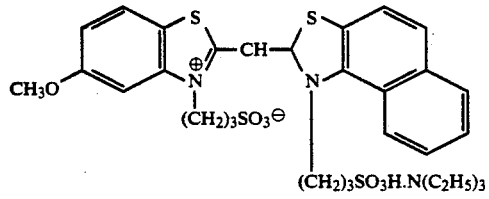
S-6
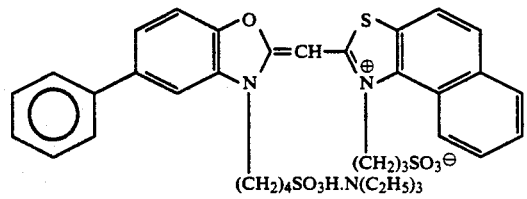

-continued
S-7
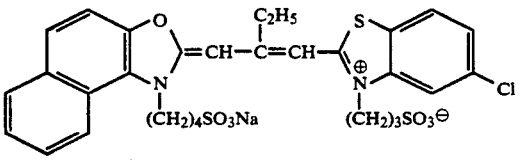
S-8
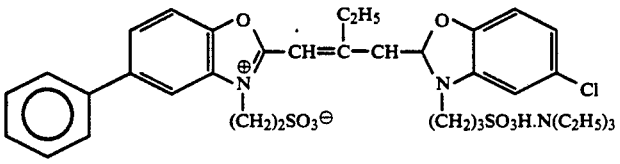
D-1
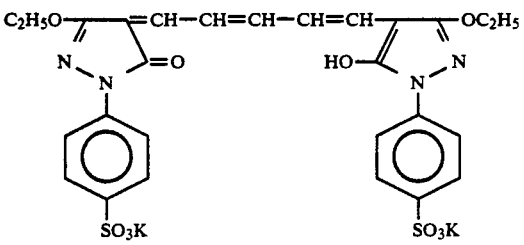
D-2
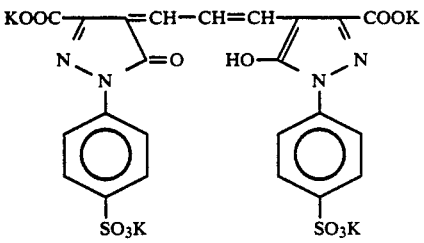
D-3
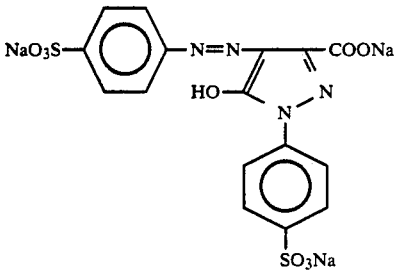
D-4
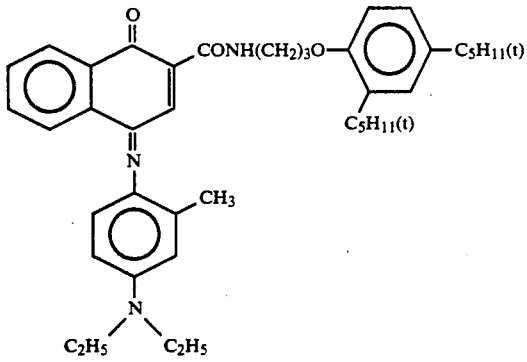
H-1
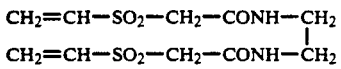
W-1
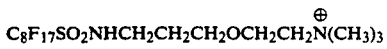

-continued
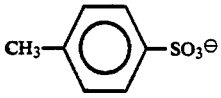
$C_8F_{17}SO_2N(C_3H_7)CH_2COOK$ W-2
$NaO_3S-CH(CH_2COOCH_2CH(C_2H_5)C_4H_9)COOCH_2CH(C_2H_5)C_4H_9$ W-3
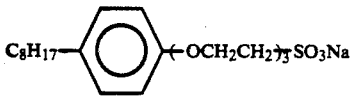
W-4
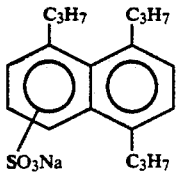
W-5
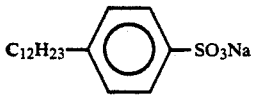
W-6
$\leftarrow CH_2-CH(CONHC_4H_9(t))\rightarrow_n$ P-1
$\leftarrow CH_2-CH(COOC_4H_9)\rightarrow_n$ M-1
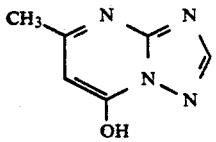
F-1
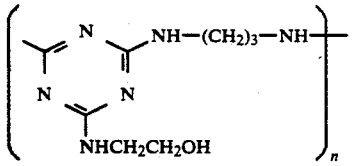
F-2
$-HNO_3$
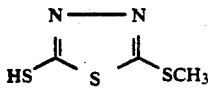
F-3
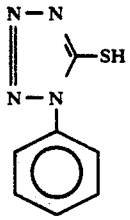
F-4

-continued

F-5

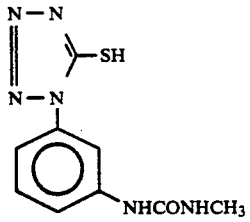

F-6

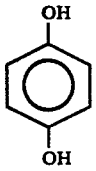

F-7

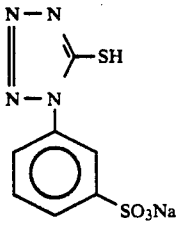

F-8

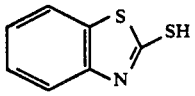

Preparation of Sample 302

Sample 302 was prepared in the same manner as in the preparation of Sample 301 except that Dye D-25 (0.25 g/m$^2$) used in Sample 202 of Example 2 and HBS-2 (0.50 g/m$^2$) used in Example 2 were used in place of the yellow colloidal silver used in the 13th layer of Sample 301.

Preparation of Samples 303 to 306

Each of Samples 303 to 306 was prepared in the same manner as in the preparation of Sample 302 except that an equal weight of each of Comparative Polymers Polymer A and Polymer B and Polymers P-2 and P-16 of the present invention was used in place of the dispersion medium HBS-2 used in the 13th layer of Sample 302.

The thus-obtained samples were exposed to white light through an optical wedge, and processed in an automatic processor by using the following Processing Methods C and D.

Good results similar to those obtained in Example 2 could be obtained by any of the Processing Methods C and D. Namely, the results for the samples of the present invention show that the sensitivity of the green-sensitive layers is high while the function of the yellow filter is satisfactorily maintained in comparison with comparative samples and that Dmin of the yellow density is equal to or less than that of Comparative Sample 301. Further, when the samples of the present invention were stored under high humidity conditions, desensitization and a lowering in maximum density were scarcely caused.

Processing Method C

| Processing Stage | Time (min) | Temp. (°C.) | Tank capacity (l) | Replenishment rate (ml/m$^2$) |
|---|---|---|---|---|
| First development | 6 | 38 | 12 | 2200 |
| First rinse | 2 | 38 | 4 | 7500 |
| Reversal | 2 | 38 | 4 | 1100 |
| Color development | 6 | 38 | 12 | 2200 |
| Compensating | 2 | 38 | 4 | 1100 |
| Bleaching | 6 | 38 | 12 | 220 |
| Fixing | 4 | 38 | 8 | 1100 |
| Second rinse | 4 | 38 | 8 | 7500 |
| Stabilization | 1 | 25 | 2 | 1100 |

Each processing solution had the following composition.

| | Tank Solution | Replenisher |
|---|---|---|
| First developing solution | | |
| Pentasodium nitrilo-N,N,N-trimethylenephosphonate | 1.5 g | 1.5 g |
| Pentasodium diethylenetriaminepentaacetate | 2.0 g | 2.0 g |
| Sodium sulfite | 30 g | 30 g |
| Potassium hydroquinone-monosulfonate | 20 g | 20 g |
| Potassium carbonate | 15 g | 20 g |
| Sodium bicarbonate | 12 g | 15 g |
| 1-Phenyl-4-methyl-4-hydroxymethyl-3-pyrazolidone | 1.5 g | 2.0 g |
| Potassium bromide | 2.5 g | 1.4 g |
| Potassium thiocyanate | 1.2 g | 1.2 g |
| Potassium iodide | 2.0 mg | — |
| Diethylene glycol | 13 g | 15 g |
| Water to make | 1000 ml | 1000 ml |

-continued

| | Tank Solution | Replenisher |
|---|---|---|
| pH | 9.60 | 9.60 |

pH was adjusted with hydrochloric acid or potassium hydroxide.

| Reversal solution | |
|---|---|
| Tank solution and replenisher were the same. | |
| Pentasodium nitrilo-N,N,N-trimethylene-phosphonate | 3.0 g |
| Stannous chloride dihydrate | 1.0 g |
| p-Aminophenol | 0.1 g |
| Sodium hydroxide | 8 g |
| Glacial acetic acid | 15 ml |
| Add water to make | 1000 ml |
| pH | 6.00 |

pH was adjusted with hydrochloric acid or sodium hydroxide.

| | Tank Solution | Replenisher |
|---|---|---|
| Color developing solution | | |
| Pentasodium nitrilo-N,N,N-trimethylene phosphonate | 2.0 g | 2.0 g |
| Sodium sulfite | 7.0 g | 7.0 g |
| Trisodium phosphate dodecahydrate | 36 g | 36 g |
| Potassium bromide | 1.0 g | — |
| Potassium iodide | 90 mg | — |
| Sodium hydroxide | 3.0 g | 3.0 g |
| Citrazinic acid | 1.5 g | 1.5 g |
| N-Ethyl-N-(β-methanesulfonamidoethyl)-3-methyl-4-aminoaniline 3/2 sulfate monohydrate | 11 g | 11 g |
| 3,6-Dithiaoctane-1,8-diol | 1.0 g | 1.0 g |
| Water to make | 1000 ml | 1000 ml |
| pH | 11.80 | 12.00 |

pH was adjusted with hydrochloric acid or potassium hydroxide.

| | Tank Solution | Replenisher |
|---|---|---|
| Compensating solution | | |
| Disodium ethylenediamine-tetraacetate dihydrate | 8.0 g | 8.0 g |
| Sodium sulfite | 12 g | 12 g |
| 1-Thioglycerol | 0.4 g | 0.4 g |
| Formaldehyde-sodium bisulfite adduct | 30 g | 35 g |
| Water to make | 1000 ml | 1000 ml |
| pH | 6.30 | 6.10 |

pH was adjusted with hydrochloric acid or sodium hydroxide.

| | Tank Solution | Replenisher |
|---|---|---|
| Bleaching solution | | |
| Disodium ethylenediamine-tetraacetate dihydrate | 2.0 g | 4.0 g |
| Ammonium ethylenediamine-tetraacetato ferrate dihydrate | 120 g | 120 g |
| Potassium bromide | 100 g | 200 g |
| Ammonium nitrate | 10 g | 20 g |
| Water to make | 1000 ml | 1000 ml |

-continued

| | Tank Solution | Replenisher |
|---|---|---|
| pH | 5.70 | 5.50 |

pH was adjusted with hydrochloric acid or sodium hydroxide.

| Fixing solution | |
|---|---|
| Tank solution and replenisher were the same. | |
| Ammonium thiosulfate | 80 g |
| Sodium sulfite | 5.0 g |
| Sodium bisulfite | 5.0 g |
| Water to make | 1000 ml |
| pH | 6.60 |

pH was adjusted with hydrochloric acid or ammonia water.

| | Tank Solution | Replenisher |
|---|---|---|
| Stabilizing solution | | |
| Benzisothiazoline-3-one | 0.02 g | 0.03 g |
| Polyoxyethylene p-monononyl-phenyl ether (average degree of polymerization: 10) | 0.3 g | 0.3 g |
| Water to make | 1000 ml | 1000 ml |
| pH | 7.0 | 7.0 |

Processing Method D

| Processing Stage | Time | Temp. (°C.) | Tank capacity (l) | Replenishment rate (ml/m²) |
|---|---|---|---|---|
| First development | 6 min | 38 | 12 | 2200 |
| First rinse | 45 sec | 38 | 2 | 2200 |
| Reversal | 45 sec | 38 | 2 | 1100 |
| Color development | 6 min | 38 | 12 | 2200 |
| Bleaching | 2 min | 38 | 4 | 860 |
| Bleaching-fixing | 4 min | 38 | 8 | 1100 |
| Second rinse (1) | 1 min | 38 | 2 | — |
| Second rinse (2) | 1 min | 38 | 2 | 1100 |
| Stabilization | 1 min | 25 | 2 | 1100 |
| Drying | 1 min | 65 | — | — |

The replenishment of the second rinsing stage was carried out by a countercurrent replenishment system wherein the replenisher was introduced into the second rinsing stage (2), and the overflow solution from the second rinsing stage (2) was introduced into the second rinsing stage (1).

Each processing solution had the following composition.

| | Tank Solution | Replenisher |
|---|---|---|
| First developing solution | | |
| Pentasodium nitrilo-N,N,N-trimethylenephosphonate | 2.0 g | 2.0 g |
| Sodium sulfite | 30 g | 30 g |
| Potassium hydroquinone-monosulfonate | 20 g | 20 g |
| Potassium carbonate | 33 g | 33 g |
| 1-Phenyl-4-methyl-4-hydroxymethyl-3-pyrazolidone | 2.0 g | 2.0 g |
| Potassium bromide | 2.5 g | 1.4 g |
| Potassium thiocyanate | 1.2 g | 1.2 g |
| Potassium iodide | 2.0 mg | — |
| Water to make | 1000 ml | 1000 ml |

-continued

| | Tank Solution | Replenisher |
|---|---|---|
| pH | 9.60 | 9.60 |

pH was adjusted with hydrochloric acid or potassium hydroxide.

| First rinsing solution | |
|---|---|
| Tank solution and replenisher were the same. | |
| Ethylenediaminetetramethylenephosphonic acid | 2.0 g |
| Disodium phosphate | 5.0 g |
| Water to make | 1000 ml |
| pH | 7.00 |

pH was adjusted with hydrochloric acid or sodium hydroxide.

| Reversal solution | |
|---|---|
| Tank solution and replenisher were the same. | |
| Pentasodium nitrilo-N,N,N-trimethylene-phosphonate | 3.0 g |
| Stannous chloride dihydrate | 1.0 g |
| p-Aminophenol | 0.1 g |
| Sodium hydroxide | 8 g |
| Glacial acetic acid | 15 ml |
| Water to make | 1000 ml |
| pH | 6.00 |

pH was adjusted with hydrochloric acid or sodium hydroxide.

| | Tank Solution | Replenisher |
|---|---|---|
| Color developing solution | | |
| Pentasodium nitrilo-N,N,N-trimethylenephosphonate | 2.0 g | 2.0 g |
| Sodium sulfite | 7.0 g | 7.0 g |
| Trisodium phosphate dodecahydrate | 36 g | 36 g |
| Potassium bromide | 1.0 g | — |
| Potassium iodide | 90 mg | — |
| Sodium hydroxide | 3.0 g | 3.0 g |
| Citrazinic acid | 1.5 g | 1.5 g |
| N-Ethyl-N-(β-methanesulfon-amidoethyl)-3-methyl-4-amino-aniline 3/2 sulfate monohydrate | 11 g | 11 g |
| 3,6-Dithiaoctane-1,8-diol | 1.0 g | 1.0 g |
| Water to make | 1000 ml | 1000 ml |
| pH | 11.80 | 12.00 |

pH was adjusted with hydrochloric acid or potassium hydroxide.

| Bleaching solution | |
|---|---|
| Tank solution and replenisher were the same. | |
| Disodium ethylenediaminetetraacetate dihydrate | 10.0 g |
| Ammonium ethylenediaminetetraacetato ferrate dihydrate | 120 g |
| Potassium bromide | 100 g |
| Ammonium nitrate | 10 g |
| Bleaching accelerator $(CH_3)_2N—CH_2—CH_2—S—S—CH_2—CH_2—N(CH_3)_2.2HCl$ | 0.005 mol |
| Water to make | 1000 ml |
| pH | 6.30 |

pH was adjusted with hydrochloric acid or ammonia water.

| Bleach fixing solution | |
|---|---|
| Tank solution and replenisher were the same. | |
| Disodium ethylenediaminetetraacetate dihydrate | 5.0 g |
| Ammonium ethylenediaminetetraacetato ferrate dihydrate | 50 g |
| Ammonium thiosulfate | 80 g |
| Sodium sulfite | 12.0 g |
| Water to make | 1000 ml |
| pH | 6.60 |

pH was adjusted with hydrochloric acid or ammonia water.

Second rinsing water

The tank solution and replenisher were the same.

Tap water was passed through a mixed bed column packed with an H type strongly acidic cation exchange resin (Amberlite IR-120B manufactured by Rohm & Haas Co.) and an OH type strongly basic anion exchange resin (Amberlite IR-400) to reduce the concentration of each of calcium ion and magnesium ion to not higher than 3 mg/l. Subsequently, sodium dichlorinated isocyanurate (20 mg/l) and sodium sulfate (1.5 g/l) were added thereto. The pH of the solution was in the range of 6.5 to 7.5.

| Stabilizing solution | |
|---|---|
| Tank solution and replenisher were the same. | |
| Formalin (37%) | 0.5 ml |
| Polyoxyethylene p-monononylphenyl ether (average degree of polymerization: 10) | 0.3 g |
| Triazole | 1.7 g |
| Piperazine hexahydrate | 0.6 g |
| Water to make | 1000 ml |
| pH | not adjusted |

While the invention has been described in detail and with reference to specific embodiments thereof, it will be apparent to one skilled in the art that various changes and modifications can be made therein without departing from the spirit and scope thereof.

What is claimed is:

1. A silver halide photographic material having at least one hydrophilic colloid layer containing a dispersion obtained by emulsifying and dispersing a solution containing at least one oil-soluble dye and at least one water-insoluble, organic solvent-soluble polymer having at least one repeating unit represented by the following general formula (I):

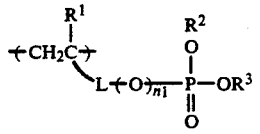

(I)

wherein $R^1$ represents a hydrogen atom, a substituted or unsubstituted alkyl group having 1 to 4 carbon atoms, or a halogen atom; $R^2$ and $R^3$ may be the same or different and each represents a substituted or unsubstituted alkyl group or a substituted or unsubstituted aryl group; L represents a bivalent bonding group; and $n_1$ represents 0 or 1.

2. A silver halide photographic material as in claim 1, wherein said oil-soluble dye is represented by the following general formula (II):

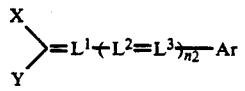

(II)

wherein X and Y each represents an electron attractive group, or X and Y are combined together to form an acid nucleus; Ar represents a phenyl group or a heterocyclic group; $L^1$, $L^2$ and $L^3$ each represents a methine group; and $n_2$ represents 0, 1 or 2.

3. A silver halide photographic material as in claim 1, wherein said oil-soluble dye is represented by the following general formula (III):

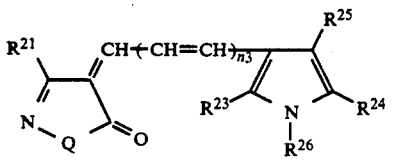

(III)

wherein $R^{21}$ represents a hydrogen atom, an alkyl group, an aryl group, —$COOR^{27}$, —$COR^{27}$, —$CONR^{27}R^{28}$, —CN, —$OR^{27}$, —$NR^{27}R^{28}$ or —$N(R^{27})COR^{28}$; Q represents an oxygen atom or —$NR^{22}$; $R^{22}$ represents a hydrogen atom, an alkyl group, an aryl group or a heterocyclic group; $R^{23}$, $R^{24}$ and $R^{25}$ each represents a hydrogen atom, an alkyl group or an aryl group, or $R^{24}$ and $R^{25}$ may be combined together to form a six-membered ring; $R^{26}$ represents a hydrogen atom, an alkyl group, an aryl group or an amino group; $R^{27}$ and $R^{28}$ each represents a hydrogen atom, an alkyl group or an aryl group; and $n_3$ represents 0 or 1.

4. A silver halide photographic material as in claim 1, wherein $R^1$ represents a hydrogen atom or a methyl group.

5. A silver halide photographic material as in claim 1, wherein $n_1$ is 1 and L is an alkylene group or an arylene group which is bonded to a hetero atom.

6. A silver halide photographic material as in claim 1, wherein the water-insoluble, organic solvent-soluble polymer is a copolymer comprising repeating units of general formula (I) and repeating units of a hydrophobic monomer having an acid group.

7. A silver halide photographic material as in claim 1, wherein the repeating units of general formula (I) constitute 50 to 100% by weight of the water-insoluble, organic solvent-soluble polymer.

8. A silver halide photographic material as in claim 1, wherein the oil soluble dye is insoluble in water and has a solubility in ethyl acetate of at least 10 grams per liter at 40° C.

9. A silver halide photographic material as in claim 1, wherein the oil-soluble dye is used in such an amount as to give an optical density of 0.05 to 3.5.

* * * * *